US010221553B2

(12) United States Patent
Jensen

(10) Patent No.: US 10,221,553 B2
(45) Date of Patent: Mar. 5, 2019

(54) TOILET FLUSH VALVE ASSEMBLIES

(71) Applicant: AS IP Holdco, LLC, Piscataway, NJ (US)

(72) Inventor: Robert M. Jensen, East Brunswick, NJ (US)

(73) Assignee: AS IP HOLDCO, LLC, Piscataway, NJ (US)

( * ) Notice: Subject to any disclaimer, the term of this patent is extended or adjusted under 35 U.S.C. 154(b) by 271 days.

(21) Appl. No.: 14/038,748

(22) Filed: Sep. 27, 2013

(65) Prior Publication Data

US 2014/0090158 A1 Apr. 3, 2014

Related U.S. Application Data

(60) Provisional application No. 61/708,892, filed on Oct. 2, 2012.

(51) Int. Cl.

| | |
|---|---|
| ***E03D 5/094*** | (2006.01) |
| ***E03D 1/30*** | (2006.01) |
| *E03D 1/33* | (2006.01) |

(52) U.S. Cl.

CPC ..... *E03D 5/094* (2013.01); *E03D 1/308* (2013.01); *E03D 1/33* (2013.01)

(58) Field of Classification Search

CPC ..... E03D 5/094; E03D 1/308; E03D 1/33
USPC ..... 4/378
See application file for complete search history.

(56) References Cited

U.S. PATENT DOCUMENTS

| | | | | |
|---|---|---|---|---|
| 1,103,550 | A * | 7/1914 | Stevens | 4/382 |
| 1,391,477 | A | 9/1921 | Hinsdale et al. | |
| 3,151,339 | A | 10/1964 | Chase | |
| 3,988,785 | A | 11/1976 | Schoepe et al. | |
| 4,091,474 | A | 5/1978 | Makhobey | |
| 4,145,776 | A | 3/1979 | Crosby et al. | |
| 4,557,000 | A | 12/1985 | Strangfeld | |
| 4,604,763 | A | 8/1986 | Sprang | |
| 4,651,359 | A | 3/1987 | Battle | |
| 5,040,247 | A | 8/1991 | Stevens | |
| 5,054,133 | A | 10/1991 | Pickerrell et al. | |

(Continued)

OTHER PUBLICATIONS

International Search Report and Written Opinion for PCT/US2013/062532, dated Mar. 18, 2014—13 pages.

(Continued)

*Primary Examiner* — Janie M Loeppke

(74) *Attorney, Agent, or Firm* — Venable LLP; Michele V. Frank

(57) ABSTRACT

Flush valve assemblies are described herein which include a valve body; a flush valve cover detachably connected to a flush line; a pivot mechanism capable of opening and closing the flush valve cover upon actuation; wherein the flush line is connected at a first end to a flush actuating device and at a second end to the flush valve cover, the line being capable of raising and lowering the cover upon actuation; and a float situated above the cover and connected to the flush line at a point between the first and the second ends of the flush line or by a separate float line connected to the cover. The float is sufficiently buoyant and capable of resisting the force of flowing water and keeping the flush valve cover open to allow flush water to pass through the valve body before closing the cover when the valve body is installed on a toilet.

40 Claims, 11 Drawing Sheets

(56) References Cited

U.S. PATENT DOCUMENTS

| | | | |
|---|---|---|---|
| 5,153,948 | A | 10/1992 | Smith et al. |
| 5,170,515 | A | 12/1992 | Kai et al. |
| 5,195,189 | A | 3/1993 | Gibb |
| 5,204,999 | A | 4/1993 | Makita et al. |
| 5,216,761 | A | 6/1993 | Isberg |
| 5,329,647 | A | 7/1994 | Condon |
| 5,579,542 | A | 12/1996 | Hayman |
| 5,692,249 | A | 12/1997 | Johnson |
| 5,694,652 | A | 12/1997 | Stock et al. |
| 5,983,413 | A | 11/1999 | Hayashi et al. |
| 6,145,138 | A | 11/2000 | Nakamura et al. |
| 6,237,164 | B1 | 5/2001 | LaFontaine et al. |
| 6,415,457 | B2 | 7/2002 | Schmucki |
| 6,442,772 | B2 | 9/2002 | Han et al. |
| 6,715,162 | B2 | 4/2004 | Han et al. |
| 6,728,975 | B2 | 5/2004 | Ha |
| 6,742,194 | B2 | 6/2004 | Shim |
| 6,901,610 | B1 | 6/2005 | Jensen et al. |
| 6,983,413 | B2 | 1/2006 | Otake et al. |
| 7,676,858 | B2 | 3/2010 | Halloran et al. |
| 8,079,095 | B2 | 12/2011 | Jensen |
| 8,266,733 | B2 * | 9/2012 | Jensen ..... 4/378 |
| 2004/0088782 | A1 | 5/2004 | Antunez |
| 2005/0217013 | A1 | 10/2005 | Horvath |
| 2006/0185068 | A1 | 8/2006 | Halloran et al. |
| 2007/0101486 | A1 | 5/2007 | Torres et al. |
| 2008/0047052 | A1 | 2/2008 | Han |
| 2009/0255043 | A1 | 10/2009 | Halloran et al. |
| 2009/0276947 | A1 | 11/2009 | Schuster et al. |

OTHER PUBLICATIONS

Written Opinion for PCT/US2013/062532, dated Apr. 7, 2015—11 pages.

Mexican Office Action dated Aug. 7, 2018 in corresponding Mexican Application No. MX/a/2015/004189 (5 pages).

* cited by examiner

TOILET FLUSH VALVE ASSEMBLIES

CROSS-REFERENCE TO RELATED APPLICATIONS

This application claims the benefit under 35 U.S.C. § 119(e) of U.S. Provisional Patent Application No. 61/708,892, filed Oct. 2, 2012, entitled, "Toilet Flush Valve Assemblies," the entire disclosure of which is incorporated herein by reference.

BACKGROUND OF THE INVENTION

Field of the Invention

The present invention relates to plumbing in a water closet or toilet water tank of a toilet, and more particularly to flush valve assemblies for use in the water tank of a toilet assembly.

Description of Related Art

Toilets and toilet assemblies for removing waste products are well known. Typically, toilets incorporate three systems that work together to perform the flushing action. Those systems are (1) the bowl, which includes a waste receptacle in fluid communication with a drain line (2) the flush mechanism, and (3) the refill mechanism. Working in concert, these three systems enable the flushing function of the toilet.

Usually, the toilet tank, positioned over the back of the toilet bowl in the toilet assembly, holds water that is used to flush waste from the toilet bowl, through a trapway and to a sewage drain line, as well as refilling the bowl with fresh water. When a user wants to flush the toilet, the user pushes down on a flush lever or other flush actuator on the outside of the tank, which is connected on the inside of the tank typically to a movable chain and/or lever. When the flush lever is depressed on the outside of the tank, the chain or lever on the inside of the tank acts to lift and open the flush valve, enabling water to flow from the tank into the bowl, thus initiating the toilet flush.

In many toilet designs, water flows directly into the bowl and can also be dispersed into the rim of the toilet bowl. The water releases into the bowl rather quickly, with flow from the tank into the bowl typically lasting approximately two to four seconds. The water flows from the rim, and down a channel within the sides of the bowl, into the large hole at the bottom of the toilet, known as a siphon jet. The siphon jet releases most of the water into the siphon tube, initiating the siphon action. The siphoning action draws all the water and waste out the bowl, and into the siphon tube. The waste and water continues through the other end of a generally U-shaped siphon tube (also known as a trapway), and is then released into the wastewater or sewage drain line connected at the base of the toilet.

Once the tank is discharged during the flush, the flush valve is closed, and a floating mechanism, which has now dropped in the tank to some residual amount, initiates the opening of the fill valve. The fill valve provides fresh water to both the tank and the bowl through separate flows. Eventually, the tank fills with water to a high enough level to cause the float to rise, thus shutting off the fill valve. At this point, the flushing cycle is complete.

Government agencies have continually demanded that water use for flushing be reduced. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 mandates that toilets sold in the United States can use water in an amount of 1.6 gallons/flush (6 liters/flush) or less.

One attempt in the art to produce a more reliable, more efficient and more powerful 1.6 gallon (6 liter) gravity flush toilet, known as a "high-performance toilet" (HPT), while overcoming the detriments in toilet technology by increasing the hydraulic energy available during the flushing operation, can be found in U.S. Pat. No. 6,901,610 entitled, "High Performance Valve Assembly For Toilets"; U.S. Pat. No. 6,728,975 entitled, "High Performance Flush Valve Assembly"; and U.S. Pat. No. 6,715,162 for "Toilet Assembly," each of which is co-owned by the owner of the present application. Relevant portions of these patents to the extent they describe radiused inlet technology and general toilet tank operation and construction are incorporated herein by reference.

These patents disclose a flush valve assembly for a water tank of a toilet that includes a valve body secured thereto. The valve body has a base sleeve portion including a radiused inlet to increase the discharge coefficient of the valve opening. A flush cover member is coaxially and slidably mounted with respect to the valve body so that the valve opening is created therebetween when the flush cover member is removed from the valve body via reciprocating motion. The flush cover member is slidably movable between a first position, wherein the flush cover member is seated on the base sleeve portion of the valve body and thereby obstructs water flow through the valve opening, and a second position, wherein the second valve member is removed from the base sleeve portion of the valve body to permit water flow through the valve opening. A sealing member is provided to ensure a proper seal when the flush cover member is in the first position, and a guiding means is provided that properly aligns and guides the flush valve cover relative to the valve body. The flush valve assembly also includes a trip release mechanism that releases the effects of the flush lever on the flush cover member when the flush cover member reaches its second position, thereby returning the flush cover member to its first rest position prior to the flush lever returning to its own corresponding rest position. In this configuration, the disclosed flush valve assembly ensures compliance with the mandated water requirements and simultaneously provides enhanced cleanliness and waste removal capabilities. The flush valve assembly achieves these functions and also releases the effect of the flush lever so that the valve opening can close before the expiration of a regulatory minimum "hold down" time (1 second without exceeding the total water per flush mandate of 1.6 gallons (6 liters)).

Although these prior solutions noted in the above-patents effectively remove waste from toilet bowls within government guidelines, such guidelines no longer mandate a minimum "hold down time". It is therefore desirable to provide the aforementioned benefits in a flush valve assembly having minimal moving parts for ease of manufacturing, installation, operation and maintenance. Such advantage should be incorporated in the flush valve assembly without compromising the water conservation benefits of the prior flush solutions.

Alternative technologies proposed for providing adequate flush valve efficiency for high-performance toilets may be found in U.S. Pat. No. 7,676,858 B2 which proposes the use of a flush valve that has a valve body with a valve seat that defines a flow passage having a portion of its interior flow profile that narrows in a non-linear manner away from the valve seat such that the inner surface of the valve seat in the non-linear portion can be defined by a polynomial expression, i.e., the valve body has a non-linearly curved inner surface.

U.S. Pat. No. 8,079,909 B2 discloses a flush valve that accomplishes water conservation and flush efficiency, as well as the performance goals noted above, by providing a more efficient combination of a radiused inlet and an optional elevated valve body. The flush valve assembly disclosed therein may also have a "poppet" or centrally aligned and guided buoyant float cover for the valve body. This particular design is highly effective if an upwardly buoyant and centrally guided flush cover is used, because the upward lifting of such a cover provides for water intake into the valve opening in a 360° configuration. That is, when the buoyant cover lifts, it allows for water to flow in from all directions into the valve opening for supplying water from the toilet tank to the toilet bowl.

Problems may be encountered when using an elevated valve body having an optimal radiused inlet designed to enhance flow and maximize hydraulic energy through the valve body with a standard flapper-type valve cover. Such standard flush valve covers are known in the art, readily available and it would be desirable to be able to use such commercially available covers with a high-efficiency valve body design. Flush valve body assemblies having a radiused inlet and elevated valve body, used with the above-noted, poppet, centrally-guided flush valve cover, are able to handle the increased efficiency and maximized flow through the valve body at reduced volumes of water so as to be useful as high-performance flush valves working with HPT toilets having toilet bowl designs and flush pathways that achieve the 1.6 gallons/flush water conservation standards, some of which may be qualified as high-efficiency toilets (HET) which provide effective flushing at as low as about 1.28 gallon per flush or even lower.

Using a standard two-inch diameter inlet, the flow rate through a high-efficiency flush valve designed to function with high-efficiency toilets (HETs) is very high, even though the volume in the toilet tank available for flushing is smaller than it might be in prior art traditional toilets. A traditional flush valve cover's performance used with such a valve body and a two-inch inlet becomes affected in terms of its ability to close when appropriate, sometimes closing prematurely, and in terms of its ability to re-open. This problem can be exacerbated in a radiused inlet valve body design, because the extension of the inlet opening due to the presence of the radius, which is optimized for high-efficiency flow through the valve body, can require an even larger sized flapper to cover the opening created by the radius which increases the force required to open the valve and actuate the flush. Furthermore, the high velocity flow enabled by the radiused inlet can counteract the buoyant force of the flapper and cause the valve to close prematurely. These factors combine to make it difficult to properly open and close a standard flapper on a valve assembly configured for use in an HPT or, preferably an HET and having an elevated valve body and radiused inlet, even in comparison to standard low profile, non-elevated flush valve bodies having standard flapper-type valve covers, for example, a commercially available Fluidmaster® Flush Valve Model 507.

Another problem encountered in prior art flush valve designs is that such flush valves, whether suitable for high-efficiency toilets or not, when optimized for flow design, have outlets which, when installed, introduce fluid flow directly into an inlet chamber of a toilet bowl having a lower floor which lies in a plane perpendicular to the flow coming out of the flush valve outlet. The impact of the contact against the bottom surface of the inlet chamber (which may be a manifold) of water under a high flow rate through the valve caused by flushing, introduces undesirable turbulence which reduces the hydraulic energy available from the water exiting the outlet of the flush valve. Prior art designs are available from the owner of the present application in which a fitting is used on the bottom of a flush valve outlet to divide and direct the flush valve outlet flow into two separate directions so as to introduce flow into the rim area and into the jet area of the toilet bowl. Such designs do avoid some of the impact issue, for certain particular high-efficiency toilet designs.

Based on the foregoing, there is a need in the art for a flush valve that can utilize the advantages of an elevated valve body having a radiused inlet suitable for use in HPTs, and preferably HETs, but which allows for adaptation and use of traditional flush valve covers (flappers). It would also be useful to provide a flush valve assembly configured by using pre-existing commercial flush valves having a lower valve body profile with new detachable sections to provide the same effect as an elevated valve body with a radiused inlet and which can make use of a standard flush valve cover.

There is also a need in the art for a flush valve that can provide an outlet opening that overcomes the potential hydraulic loss associated with impact on the floor of a toilet bowl inlet chamber but which can be used with any type of toilet bowl design having an inlet chamber therein.

U.S. Pat. No. 8,266,733 B2 discloses a flush valve that accomplishes water conservation and flush efficiency, as well as the performance goals noted above, by providing a more efficient combination of a radiused inlet and an optional elevated valve body where at least a portion of the valve body wall is downwardly linearly tapered. The publication also describes use of a bulb underneath the flush valve cover for the valve body to provide buoyancy, with the bulb sized and configured to fit within the inlet of the valve body. Although the bulb provides required buoyancy, it occupies space in the flow path when the valve is opened, which can reduce the flow rate below its maximum potential. When greater buoyancy is required, the size of the bulb must increase, further exasperating this drawback.

However, there remains a desire in the art to continue to increase the efficiency and performance of HPTs and HETs, and more particularly, for a higher efficiency flapper for a flush valve that can stay open longer at higher flush rates, which in turn, improves toilet performance.

BRIEF SUMMARY OF THE INVENTION

The invention includes a flush valve assembly, comprising a valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the valve body from the inlet opening to the outlet opening and that has a generally circular transverse cross-section, wherein at least a portion of the wall is downwardly linearly tapered and has a decreasing valve body diameter as measured transversely across the valve body, and the tapered wall portion is below the radiused inlet portion, wherein a height measured longitudinally through the valve body is about the same as or greater than a largest diameter of the transverse cross-section of the flow path; a flush valve cover detachably connected to a flush line; a pivot mechanism capable of opening and closing the flush valve cover upon actuation of the flush valve, wherein the flush valve cover has a transverse cross-sectional diameter sufficiently large to cover the inlet opening of the valve body; the flush line connected at a first end to a flush actuating device or a flush line and connectable at a second end to the flush valve cover, the line being capable of raising and lowering the flush valve cover upon actuation of the assembly; and a float connected to the flush valve cover via a float line or by being positioned along the flush line; wherein the float is sufficiently buoyant so as to be capable of resisting the force of flowing water, keeping the flush valve cover open so as to allow flush water to pass through the valve body before closing the flush valve cover when the valve body is installed on a toilet. The float is preferably sufficiently buoyant so as to be capable of resisting the force of flowing water and keep the flush valve cover open so as to allow flush water to pass through the valve body when the valve body is installed on a toilet having a flush volume of about 1.6 gallons per flush or less, more preferably having a flush volume of about 1.28 gallons per flush or less, before closing the valve cover. The float may be connected to the flush valve cover by a float line or adjustably connected to the flush valve cover by the flush line. The float line and the flush line may be formed from materials selected from the group comprising plastic, metal, chain link, string, cord, rope, twine, stainless steel cable, fiber, rigid rod or wire.

The valve body wall in the above-noted flush valve assembly may optionally further comprise an upper inlet section for contacting the flush valve cover when the valve cover is in the closed position; a base section for attaching to a toilet tank floor; and an extension section situated between the inlet section and the base section. The upper inlet section, the base section and the extension section may be detachably connected to each other or the upper radiused inlet section, the base section and the extension section may be integrally formed as a unitary structure and variations thereof. In the above-noted assembly, at least one of an interior surface of the base section and the extension section may be tapered so as to have a linearly decreasing diameter from an upper end of each section in a direction towards a lower end of each section, wherein the diameters are measured transversely across each section, and further both of the interior surfaces of the base section and the extension section may be tapered.

A diameter of the lower outlet end of the valve body is preferably about 2 inches, and the float preferably has a buoyant force which is equivalent to a force needed to displace at least about 70 grams to about 170 grams of water with air, more preferably at least about 100 grams to about 140 grams of water with air, and most preferably at least about 120 grams of water with air. The float is also capable of maintaining the valve in an open position in a tank having a starting water head of about 9 inches to about 10 inches above the valve body so as to provide a peak flow rate measured at the outlet of the flush valve of at least about 5900 ml/s.

The radius of the radiused inlet in the above-noted valve assembly may be about ⅛ inch to about 2 inches, preferably ⅛ inch to 1⅓ inches, and more preferably ⅜ inch.

The upper inlet end of the wall may also further comprise at least one peripheral rib formed on the interior surface of the wall and extending at least partially longitudinally along the flow path and at least partially transversely inwardly from the interior surface into the flow path.

The invention further includes a flush valve assembly useful for a high efficiency toilet, comprising a valve body having a radiused inlet portion, an upper inlet end having an inlet opening therethrough, a lower outlet end having an outlet opening therethrough, a wall extending between the upper inlet end and the lower outlet end and having an interior surface defining a flow path that extends generally longitudinally through the valve body from the inlet opening to the outlet opening and that has a generally circular transverse cross-section, wherein the wall has an upper inlet section, a base section for attaching to a toilet tank floor, and an extension section situated between the inlet section and the base section, wherein an upper portion of the base section is tapered so as to have a linearly decreasing diameter from an upper end of the base section in a direction towards a lower end of the base section, wherein the diameters of the base section are measured transversely across the base section, wherein a height measured longitudinally through the valve body is about the same as or greater than a largest diameter of the transverse cross-section of the flow path; and a flush valve cover detachably connected to a flush line; a pivot mechanism capable of opening and closing the flush valve cover upon actuation of the flush valve, wherein the flush valve cover has a transverse cross-sectional diameter sufficiently large to cover the inlet opening of the valve body; the flush line connected at a first end to a flush actuating device and connectable at a second end to the flush valve cover, the line being capable of raising and lowering the flush valve cover upon actuation of the assembly; and a float connected to the flush valve cover via a float line or by being positioned along the flush line; wherein the float is sufficiently buoyant so as to be capable of resisting the force of flowing water, keeping the flush valve cover open so as to allow flush water to pass through the valve body before closing the flush valve cover when the valve body is installed on a toilet. The float is preferably sufficiently buoyant so as to be capable of resisting the force of flowing water and keep the flush valve cover open so as to allow flush water to pass through the valve body when the valve body is installed on a toilet having a flush volume of about 1.6 gallons per flush or less, more preferably having a flush volume of about 1.28 gallons per flush or less, before closing the valve cover. The float may be connected to the flush valve cover by the float line or adjustably connected to the flush valve cover by the flush line.

The above-noted embodiment of a valve body may further comprise an extension section which may be tapered so as to have a linearly decreasing diameter from an upper end of the extension section to the lower end of the extension section, wherein the diameters of the extension section are measured transversely across the extension section.

The upper inlet end of the wall in such an embodiment may also further comprise at least one peripheral rib formed on the interior surface of the wall and extending at least partially longitudinally along the flow path and at least partially transversely inwardly from the interior surface into the flow path.

A further flush valve assembly is also contemplated as being within the invention which comprises a valve body having an upper inlet end having an inlet opening therethrough, a lower outlet end having an outlet opening therethrough, a radiused outlet portion, a wall extending between the upper inlet end and the lower outlet end and having an interior surface defining a flow path that extends generally longitudinally through an upper inlet portion of the valve body, wherein the flow path has a generally circular transverse cross-section therein, and that extends through the radiused outlet portion, wherein the radiused outlet portion includes a longitudinally depending section of the wall of the valve body and terminates in the lower outlet end of the valve body, wherein the longitudinally depending wall section has a curved elbow portion, wherein the valve body having the radiused outlet portion is configured so as to be capable of directing water through the flow path from a generally downwardly directed longitudinal flow through the upper inlet portion of the valve body, along the curved elbow portion of the radiused outlet portion and into a transversely directed flow upon exiting the lower outlet end of the valve body towards an inlet of a bowl of a toilet assembly, wherein the lower outlet end has a generally semi-circular longitudinal cross-section; a flush valve cover detachably connected to a flush line; a pivot mechanism capable of opening and closing the flush valve cover upon actuation of the flush valve, wherein the flush valve cover has a transverse cross-sectional diameter sufficiently large to cover the inlet opening of the valve body; a flush line connected at a first end to a flush actuating device and connectable at a second end to the flush valve cover, the line being capable of raising and lowering the flush valve cover upon actuation of the assembly; and a float connected to the flush valve cover via a float line or by being positioned along the flush line; wherein the float is sufficiently buoyant so as to be capable of resisting the force of flowing water, keeping the flush valve cover open so as to allow flush water to pass through the valve body before closing the flush valve cover when the valve body is installed on a toilet.

In such an embodiment, the valve body comprises a radiused inlet portion on the upper inlet portion of the valve body, and wherein at least a portion of the interior surface of the valve body may be downwardly linearly tapered. The valve body preferably has a diameter measured transversely across the valve body at a location where the valve body would be situated so as to pass through a toilet tank floor when installed on a toilet and above the radiused outlet portion which is about 2 inches, and the radiused inlet portion has a radius which is about ⅛ to about 2 inches, preferably ⅜ inch. The float is preferably sufficiently buoyant so as to be capable of resisting the force of flowing water and keeping the flush valve cover open so as to allow flush water to pass through the valve body when the valve body is installed on a toilet having a flush volume of about 1.6 gallons per flush or less, more preferably having a flush volume of about 1.28 gallons per flush or less, before closing the flush valve cover.

The upper inlet end of the valve body in this embodiment lies in a plane that is at an acute angle with the transverse cross section of the flow path taken at a location in the upper inlet portion of the valve body, wherein the angle is configured to create a wider inflow area for water entering the valve body when the flush valve cover is open to facilitate increased flow of water into the inlet opening of the valve body.

In the above-noted embodiment, the radiused outlet portion may be detachably connected to the upper inlet portion of the valve body, or the radiused outlet portion may be integrally formed with the upper inlet portion of the valve body as a unitary structure and variations thereof.

The upper inlet end of the wall may also further comprise at least one peripheral rib formed on the interior surface of the wall and extending at least partially longitudinally along the flow path and at least partially transversely inwardly from the interior surface into the flow path.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
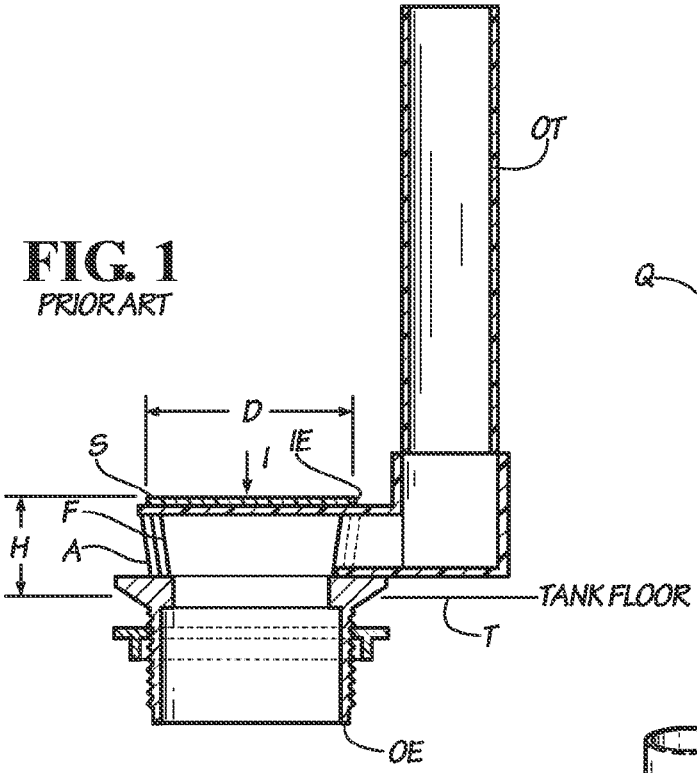
FIG. 1 PRIOR ART
FIG. 1 is a longitudinal cross-sectional view of a prior art flush valve.

As used herein, words such as "upper" and "lower," "interior" and "exterior," "inner" and "outer," "top" and "bottom," and words of similar import are intended to be used to assist one reviewing the specification in understanding the invention with reference to directions in the drawings of this disclosure. They are for illustrative purposes only, are intended to have their ordinary meaning and import, and are not intended to be limiting with respect to the scope of the invention.

The present invention, includes toilet flush valve assemblies that provide a more efficient and powerful performance for gravity flush toilets having flush volumes of 1.6 gallons (6 liter) or less in comparison with typical prior art flush valves having a standard flapper cover or bulb flapper cover. The assemblies herein contribute to increasing the hydraulic energy available during the flushing operation and incorporate an elevated valve body with a radiused inlet. A flush line, a float, and optionally a float line may also be included as well as a solid flush valve cover capable of sufficiently maintaining its structural integrity in higher flush flow rates. A toilet flush valve assembly described herein uses a valve body that increases available hydraulic energy by increasing effective flow diameter of the flush valve body inlet opening close to the inlet orifice diameter under dynamic conditions. Moreover, the toilet flush valve assembly has a substantially raised inlet orifice with respect to the tank bottom (i.e., an elevated valve body). The float allows for the use of higher flush water levels, i.e., above about 6 inches, more preferably above about 9 inches, and most preferably above about 10 inches from the bottom of a tank. The float can thus provide an unrestricted peak flow rate measured at an outlet of the flush valve of at least about 4800 ml/s when the starting water head in the tank is at about 6 inches or more, and at least about 5900 ml/s when the starting water head in the tank is at about 9 inches or more, resulting in better flush performance in the toilet system. Additionally, the solid flush valve flapper cover maintains its structural integrity and avoids distortion under increased water levels and higher flow rates at initial flush conditions and, thus, affects valve operation by allowing a greater flush water flow rate to be delivered to the bowl.

The device is a gravity-type flush valve assembly designed to be useful for toilets and toilet assemblies having a toilet tank for gravity/siphon-based flushing. The flush valve body is preferably formed of a polymeric material, such as a moldable thermoplastic, and constructed to have an interior surface that defines a flow path from an upper inlet end to a lower outlet end thereby allowing flush water to pass through the flush valve when open. The device preferably has a flush line connectable detachably or permanently at a first end to a flush actuating device or similar device. It is connected detachably or permanently at a second end to the flush valve cover. The flush line should be sized so as to be capable of raising and lowering the flush valve cover upon actuation of the assembly. A float is detachably or permanently connected to the flush valve cover by either the flush line and/or a separate float line and is situated above a flush valve cover in use. It is configured so as to be capable of staying afloat in flush water levels above about 6 inches or more from the bottom of a tank to provide a peak flow rate measured at an outlet of the flush valve of at least about 4800 ml/s. However, the effects of the float in high tank water volumes and on flow rate through the flush valve assemblies of the present invention can vary depending on the size and dimensions of the tank and flush valve designs used.

A flush valve cover, preferably a flapper cover is also detachably connected to the flush line. A pivot mechanism of the flush valve assembly is also provided, which is capable of opening and closing the flush valve cover upon actuation of the assembly to raise or lower the flush line. The flush valve cover has a transverse cross-sectional diameter sufficiently large to cover the inlet opening of the valve body. When closed, the valve body cover prevents the flow of flushing water into the valve until the valve is activated for flushing by means of a flush actuating device or similar device. When open, flushing water can flow into the valve body along the flow path.

The flush valve assembly may include any type of integrated overflow tube known or to be developed that allows the toilet tank to which the assembly is installed to hold a predetermined volume of water and to also serve as means or pathway to deliver any water that might be required to refill the bowl after a flush. Such overflow tubes may be any standard overflow tube and so is not a focus of the disclosure herein. It should be understood that any standard overflow tube or overflow tube to be developed, preferably formed of a polymeric material, and which preferably has protrusions capable of receiving and working with an attachment end of a valve cover, such as a flush valve cover having a pivot mechanism may be used within the scope of the invention.

The flush valve assembly may be affixed to the toilet tank via a projecting threaded stud and nut type arrangement, an expandable spud or other suitable devices or methods of attachment. For the purpose of illustrating the invention, a threaded stud and nut arrangement are used, but should not be considered limiting.

Various preferred embodiments of the invention as described herein include a flared radius, i.e., a radiused inlet portion, having a radius of about ⅛ inch (0.125 inch) to about 1 inch, and more preferably about ⅛ inch (0.125 inch) to about ⅜ inch (0.375 inch), incorporated onto an upper inlet portion of the flush valve body which acts as the sealing surface against which the valve cover contacts and sits. This radiused inlet portion improves the flow characteristics and flow capacity of the flush valve in the flush valve assembly working with the other portions of the flush valve assembly.

In addition, in other embodiments herein, the flush valve assembly can have a radiused outlet portion which acts as a flow director to smoothly change the flow direction of water flowing through the flow path of a flush valve assembly so that the water can pass through the valve body, out the outlet thereof, and into the inlet chamber of a toilet bowl in a toilet assembly with minimal loss of velocity or kinetic energy.

Embodiments of a flush valve assembly herein can provide a reliable and efficient flush valve for a 1.6 gallon (6 liter) or less gravity flush toilet assembly (HPT), and preferably for a 1.28 gallon or less gravity flush toilet assembly (HET), which has advantages over existing technology and achieves enhanced flushing performance characteristics for use in HPTs, and preferably HETs. Toilet flush valve assemblies described herein can aid in reduction of hydraulic energy loss and be utilized to more effectively remove waste material from the toilet bowl.

As noted above, traditional flush valves are constructed such that their effective flow diameter is less than their inlet orifice diameter under dynamic conditions, i.e., with a low profile valve body and not an elevated valve body configuration. By including the preferred radiused inlet portion with a standard low profile valve body effective diameter can be increased under dynamic conditions with the same orifice diameter.

Further incorporation of a radiused outlet portion having a radius equal to or greater than the radius of the valve conduit on an outlet of the valve assembly may improve the flow rate to critical flow paths within the toilet flushing system, i.e., water sent to a rim area and/or a jet from an inlet chamber by approximately 25% in some cases. In a typical existing installation of a flush valve assembly, the outlet is positioned some predetermined height above the inlet chamber floor of a toilet bowl inlet chamber, wherein the floor of the chamber runs generally perpendicular to the longitudinal axis of the valve body so as to form a blunt transition for water entering the toilet bowl from the flush valve assembly. During operation, the water flowing through the valve impacts this blunt transition creating turbulent flow, thus, increasing hydraulic losses and reducing the flow rate or energy available for flushing. By using an optional radiused outlet portion as described further herein below, such loss can be minimized or eliminated.

To fully utilize the various embodiments of the invention described herein, it is also preferred that the entire hydraulic flushing system (i.e., the hydraulic pathways within the toilet bowl as well as the flush valve body and the outlet thereof) should be optimized as to take full advantage of the various embodiments of the flush valve assemblies described herein, and preferably the toilets used with such assemblies are also high-performance toilets able to meet current industry flush volume standards of 1.6 gallons per flush or less, and more preferably high efficiency toilets capable of functioning with about 1.28 gallons per flush or less, although it will be understood that such flush valve assemblies can be easily used with standard toilet designs as well and provide performance benefits.

Figure 1A:
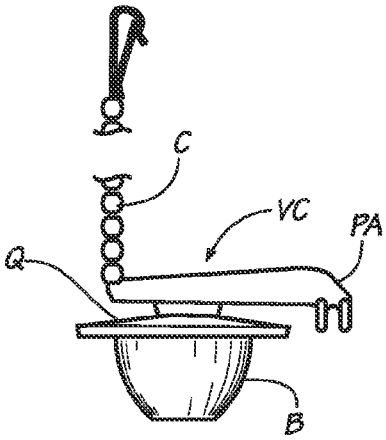
FIG. 1A PRIOR ART
FIG. 1A is a side elevational view of a prior art flapper cover for use with a prior art flush valve as in FIG. 1 for forming a prior art flush valve assembly.
Figure 2:
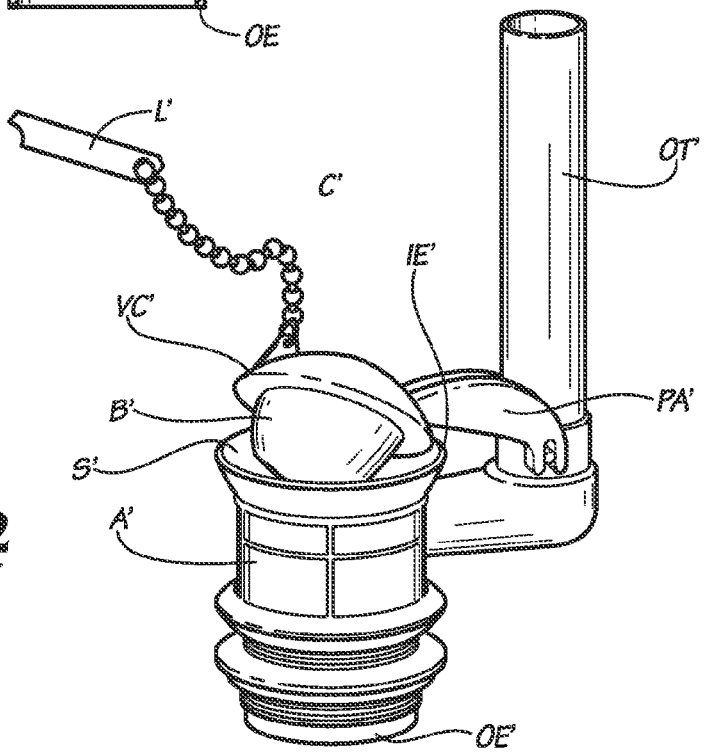
FIG. 2 PRIOR ART
FIG. 2 is a perspective view of a prior art flush valve assembly.

In a standard prior art flush valve body A with overflow tube OT for use in a standard prior art flush valve assembly as shown in FIG. 1, the valve body A has a height H above the toilet tank floor T when installed which is much less than a largest diameter D of the valve body A and provides a low profile valve body. The tapered interior surface S, which in one section of the valve body above the tank floor near the inlet end IE tapers linearly downwardly from an upper inlet end IE of the valve body in a direction towards the lower end of the valve body to aid in the flow characteristics. The flow path F follows a tapered profile when viewed in a longitudinal cross-section in the inlet portion of the valve body above the tank floor and a straight profile as the valve body transitions below the tank floor T to the outlet end OE. A prior art flush valve cover VC is shown in FIG. 1A and has a flapper bulb B and a pivot arm PA. The pivot arm PA is attached to the top Q of the valve cover VC and includes a link for attachment to a line C that can be used to lower and raise the valve cover VC through actuation of any standard valve actuator (not shown) such as a flush handle and lever, etc. FIG. 2 shows a prior art embodiment of a flush valve assembly from U.S. Pat. No. 8,266,733 B2 where the assembly has an elevated valve body A' having a radiused inlet S' and the valve cover VC', which has an alternate flapper bulb B' and a pivot arm PA'. In use, the pivot art PA' of the prior art valve cover VC' is attached to the overflow tube using a standard connection that protrudes from the overflow tube and opens and closes over the inlet opening I' in the inlet end IE' of the valve body A' in response to actuation of, for example, a flush handle.

Figure 3:
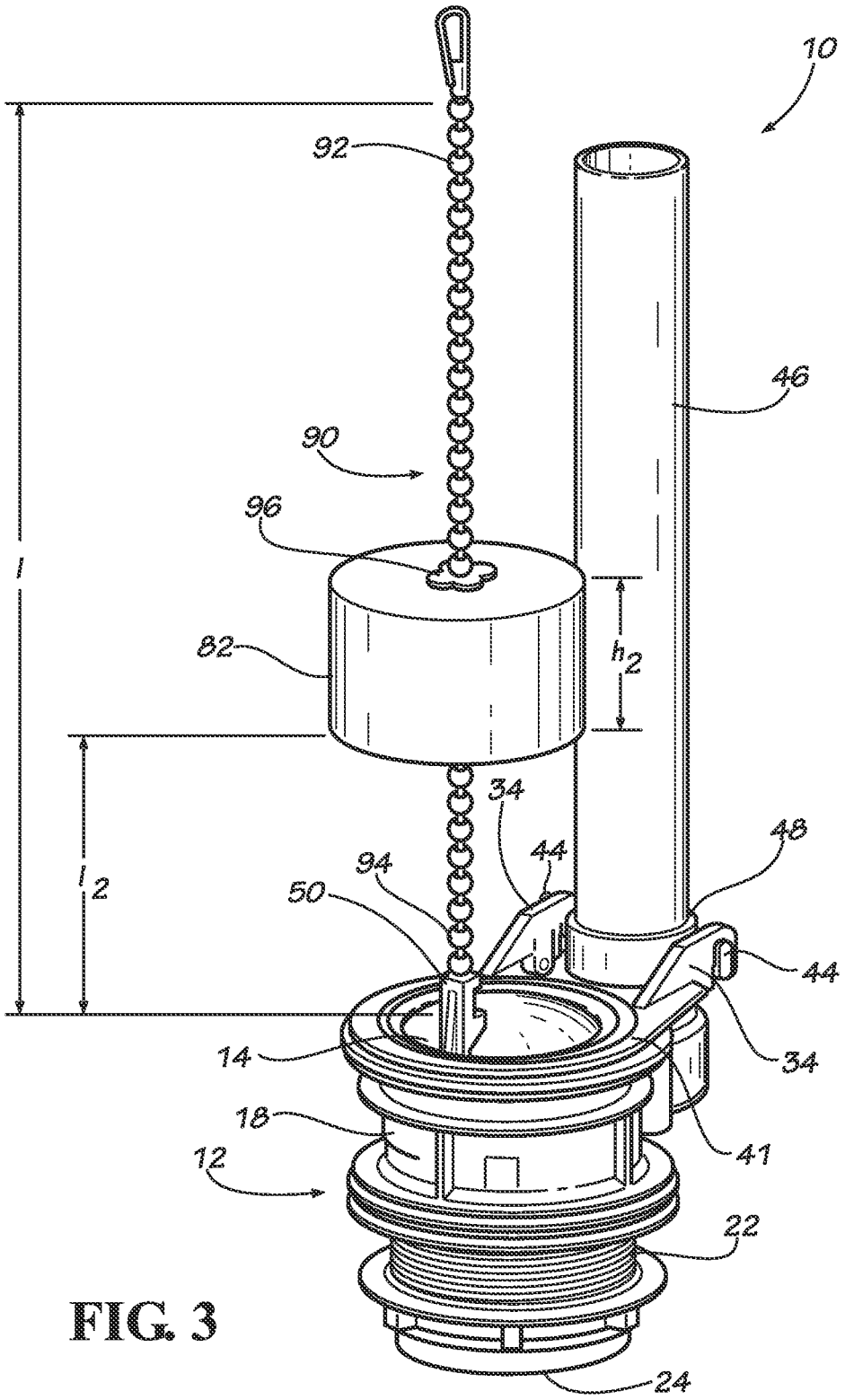
FIG. 3 is a perspective view of a flush valve assembly in closed position according to an embodiment of the invention.
Figure 3B:
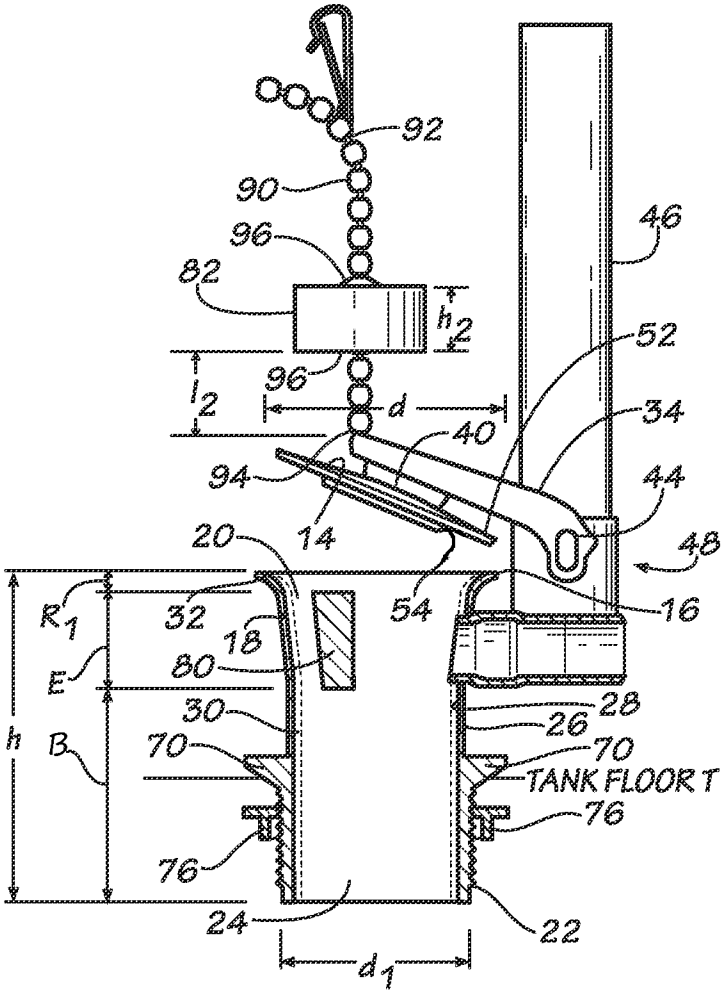
FIG. 3B is longitudinal cross-sectional view of the flush valve body portion of an installed flush valve assembly as in FIG. 3 in an opened position after actuation of a flush cycle.
Figure 3A:
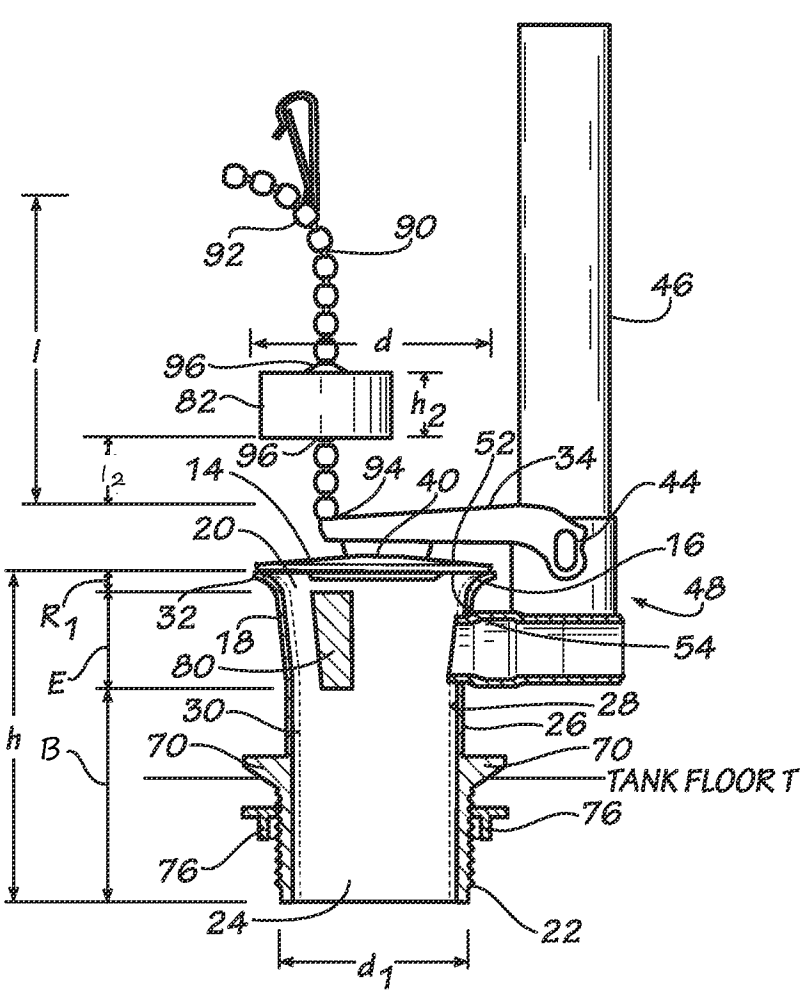
FIG. 3A is a longitudinal cross-sectional view of the flush valve body portion of the installed flush valve assembly as in FIG. 3 in a closed position.
Figure 5:
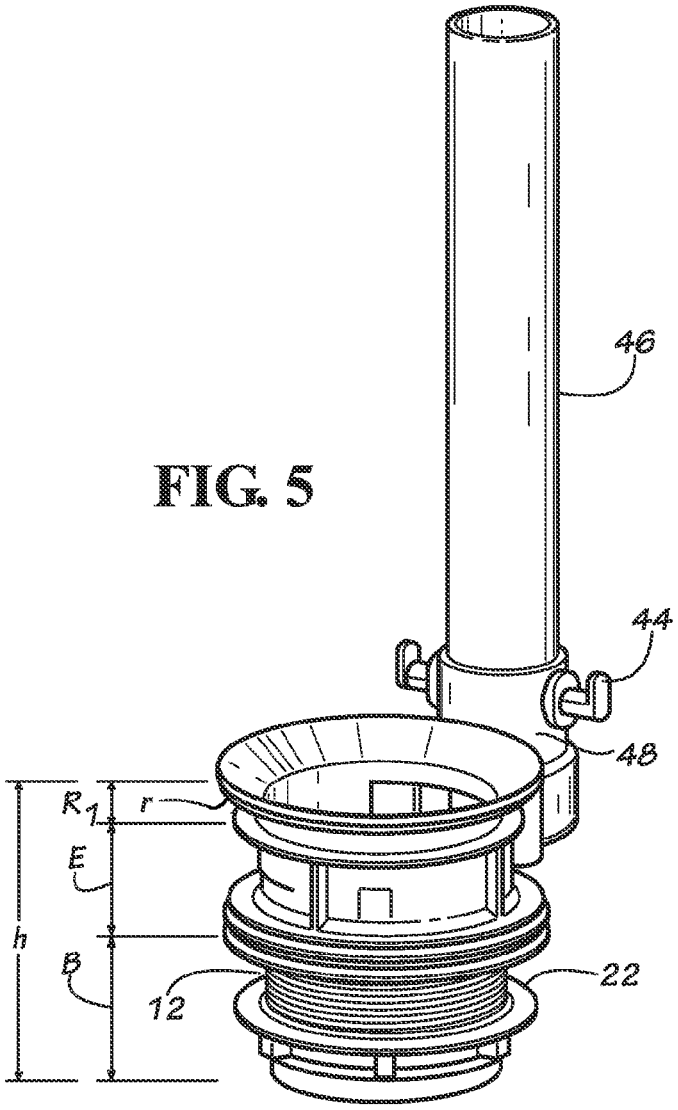
FIG. 5 is a perspective view of a portion of the assembly of FIG. 3 having the valve body and the flow tube.
Figure 5A:
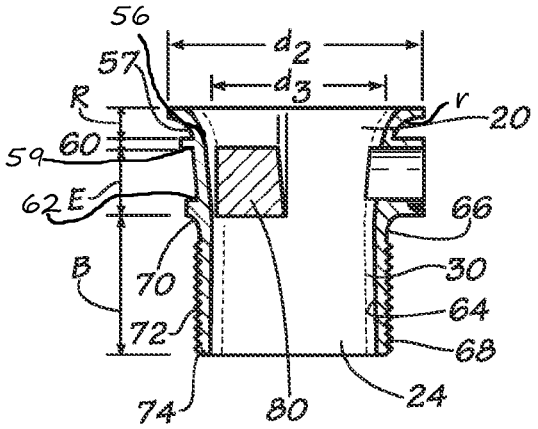
FIG. 5A is a longitudinal cross-sectional view of the valve body of FIG. 3 highlighting at least one peripheral rib.

FIG. 3 shows one embodiment of a flush valve assembly described herein. The flush valve assembly, generally referred to herein as 10, has a valve body 12 and a valve cover 14. The valve body may be formed of a variety of materials and is preferably a molded polymeric material, such as a thermoplastic, suitable for use in a water environment in a toilet tank. The valve body has a preferred radiused inlet portion 16 which extends annularly around the upper inlet end 18 of the valve body. The radiused inlet portion has a curved arcuate profile which in a longitudinal cross section, for example, as shown in FIGS. 3A, 3B, and 5A, preferably forms a circular segment having a radius r which can be measured under the curved lower surface 32 of the radiused inlet portion. The radiused inlet portion provides a curved inlet so that water flowing in curves over the radiused inlet into the valve body. It also provides a large inlet area on the upper inlet end 18 of the valve body. The radius r of the radiused inlet may be varied from about ⅛ inch to about 2 inches, but is preferably about ⅛ inch to about 1⅓ inch, and most preferably about ⅜ inch when the diameter of the lower outlet end 22 is about 2 inches.

The valve body has a wall 26 that extends between an upper inlet end 18 and a lower outlet end 22 of the valve body. The ends are preferably situated so that upon installation the upper inlet end 18 is located in a tank of a toilet and the lower end 22 is located below a tank floor T as shown in FIGS. 3A and 3B. An inlet opening 20 extends through the upper inlet end 18, wherein the inlet opening is preferably generally circular in transverse cross section. As used herein, generally circular means a curved configuration such as a circle, oval, elliptical or egg-shaped configuration, preferably circular. An outlet opening 24 extends through the lower outlet end 22, wherein the outlet opening 24 is also preferably generally circular in transverse cross section. The wall 26 may be an integrally formed wall such as to form a unitary structure valve body or may be formed of segments as discussed herein. It should also be understood that the certain segments of the wall may be integrally formed together while others can be made to be detachably connected. The segments of the wall body may thus be molded together, formed as separate piece(s) and fused or detachably connected to one another, such as by chamfering (described elsewhere herein with respect to the radiused inlet), snap-lock edge fittings, detents, screws, bolts, interlocking snap-fit pieces, connectors, and the like. Any suitable connection mechanism for adjoining the pieces may be used, provided the pieces form a tight fit and are leak-resistant. To assist in being leak-resistant, if separate pieces are joined together through mechanical mechanisms (such as screws, fittings, connectors and the like), it is preferred that a sealing member (such as a standard elastomeric or plastic O-ring or gasket suitable for plumbing use) is placed between adjoining pieces. Such sealing members are optional if the pieces form a leak-tight fit and are not likely needed if the pieces are fused or molded together.

The wall has an interior surface 28 extending the length of the valve body wall that defines the flow path 30. The flow path 30 takes the shape of the interior surface of the body wall and extends through the entire inner space of the valve body so as to create a flow path profile when viewed in longitudinal cross section through the valve body. The flow path 30 also has a generally circular transverse cross section along the valve body, however, as explained elsewhere herein, the diameter of the cross section can vary over the length of the flow path. As used herein, "diameter" means the longest measurement taken across a generally circular cross section.

Figure 8:
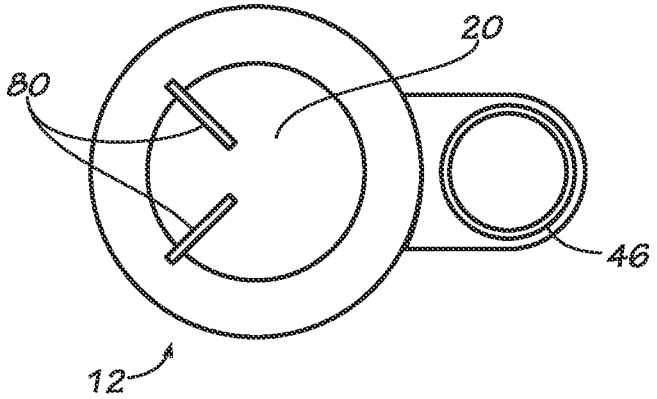
FIG. 8 is a top plan view of a valve body with multiple peripheral ribs for use in a flush valve assembly according to an alternative embodiment of the invention.

The wall interior surface 28 may include at least one peripheral rib 80 extending at least partially transversely inwardly from the interior surface into the flow path 30 and extending at least partially longitudinally along the flow path 30. The at least one optional peripheral rib 80 is shown in FIGS. 3A, 3B, 5A and 8. Flow of liquid through the flush valve body 12 into a toilet bowl remains unobstructed if the at least one peripheral rib 80 is in use. The rib(s) 80 prevent the use of an "after-market" or prior art flapper that might increase water usage above the design intent of the original product configuration when in use. The at least one peripheral rib 80 may be formed from the same materials as the valve body 12. The wall interior surface 28 may include multiple peripheral ribs 80 as shown in FIG. 8. Preferably, the at least one peripheral rib 80 is integrally formed with the wall interior surface 28.

The valve body 12 has a height h measured longitudinally through the valve body that is about the same as or greater than a largest diameter d of the transverse cross-section of the flow path (in this case measured at the radiused inlet). Preferably, the valve body is an elevated valve body and has a height h measured longitudinally through the valve body that is greater than a largest diameter d of the transverse cross-section of the flow path. This configuration allows for installation of the valve body in the toilet tank so as to provide for an elevated valve body portion lying above the toilet tank floor T. This configuration raises the flow rate through the valve body over standard valve bodies and creates more dynamic flow through the valve body while achieving the same head which can be measured herein as the distance from the upper surface of the tank water to the "choke" point or point of constriction of the valve body.

The precise height h of the valve body may be varied, but it is preferred that the height h is sufficient so that the length of the valve body above the tank floor T is larger than a standard low profile valve body and preferably approximates or is greater than the largest diameter d. The height h is preferably greater than about 2.8 inches and can be as much as about 5.2 inches, and more preferably is about 3.5 inches to about 4.1 inches. The diameter d may be preferably greater than about 2.0 inches, and more preferably about 2.25 inches to about 3.5 inches, yet more preferably about 2.4 inches to about 3.3 inches and most preferably about 3.2 inches to about 3.25 inches. The ratio of the height h to the diameter d is preferably about 2.3 to about 0.8 and more preferably about 1.7 to about 1.1.

The valve assembly 10 further includes a flush valve cover 14. The flush valve cover 14 is preferably solid and formed through molding of rigid plastic, which is formed from materials including but not limited to acrylonitrile butadiene styrene (ABS), nylon, polybutylene terephthalate (PBT), styrene, polypropylene, and polyethylene. The flush valve cover 14 is sufficiently large so as to cover the inlet opening 20 for closing the valve body and preferably is slightly larger so as to contact and close across the radiused inlet 16. The flush valve cover 14 has a general diameter $d_2$ measured transversely through the cover at its largest point of about 2.5 inches to about 6 inches, preferably having a diameter of about 2.75 inches to about 3.5 inches, and most preferably about 3 inches to 3.25 inches. The thickness t of the flush valve cover 14 measured longitudinally through the cover at its thickest point is about 0.032 inches to about 0.150 inches thick, preferably about 0.05 inches to 0.09 inches thick, and most preferably about 0.065 to about 0.075 inches thick.

This configuration as well as adequate inflexibility allows the flush valve cover 14 to work with the smaller sized, 2-inch flush valve having a radiused inlet 16 and an elevated valve body 12 as described herein. When the flush valve cover 14 is opened and a high flow rate of flush water passes through the valve body 12, the valve cover is kept open long enough for the volume of flush water to pass through the valve body when installed on an HPT, or preferably an HET, before closing. In such a manner, the flush valve cover 14 can function effectively with the high-performance, and preferably high-efficiency valve body design for use in HPT and preferably HET toilets as described herein. While the above-noted parameters can achieve that goal, it should be understood that one can modify the flush valve cover design to adjust for any added buoyancy from alternative designs, diameters and thicknesses of the valve cover if there are variations in the configuration of the elevated valve body or radiused inlet, such as by modifying the height h of the valve body, the diameter $d_1$ or the material from which the cover is made.

The valve cover 14 is preferably detachably connected to the valve assembly 10. The valve cover preferably has at least one pivot arm 34 that extends outwardly from a center section 40 of the valve body cover 14 so as to able to connect to a standard protruding arm 44 on an overflow tube 46 as part of a pivot mechanism 48. The overflow tube 46 may be configured in the same manner as standard prior art overflow tubes which are well known in the art or may have the configuration of any later developed and improved overflow tubes. The overflow tube 46 described herein can be used in any of the various embodiments described herein and sized to have connectors and fittings which interlock with and empty into an inlet tube into the valve body in a manner also known in the art. Accordingly, further description of such overflow tubes with respect to each of the other embodiments herein is omitted. In another embodiment, the at least one pivot arm(s) 34 extends outwardly from a peripheral end section 41 of the valve body cover 14 so as to able to connect to a standard protruding arm 44 on an overflow tube 46 as part of a pivot mechanism 48.

The flush valve cover 14 once connected to the assembly as shown in FIGS. 3, 3A, 3B and 6 is capable of opening and closing by a pivot motion upon actuation of a flush actuating device, such as a flush handle (not shown) or the like, which operates a lever L' or similar mechanism such as shown, for example, in prior art FIG. 2 and in the embodiment of the invention of FIG. 3. The lever L' may have a standard flush line 90 (of any line design) attached to a first end 92 thereof. The second end of the flush line 94 may also be connected to the cover by way of the pivot mechanism and may be attached to a grommet or other linkage 50 on a center section 40 or peripheral end section 41 of the flush valve cover 14 on an upper surface 52 thereof (as shown in FIG. 7). The second end of the flush line 94 may be attached to a grommet or other linkage 50 on a pivot arm 34 that is connected to a center section 40 of the flush valve cover 14 on an upper surface 52 thereof.

The flush line 90 may be formed of a variety of materials, including metal chain link, string, cord, rope, twine, cable, fiber, or wire suitable for use in a water environment in a toilet tank. Alternatively, it can be formed as a rigid rod extending upward from the flush valve cover 14. The flush line 90 is preferably a metal chain or wire to provide suitable durability in use. The flush line 90 may be connectable detachably or permanently at a first end 92 to a flush actuating device, such as a lever or similar device as is known in the art. It is also connected detachably or permanently at a second end 94 to the flush valve cover 14. Preferably, the flush line 90 is detachably connected at a first end 92 to a flush actuating device such as lever L' and detachably connected at a second end 94 to the flush valve cover 14 (directly or by a pivot mechanism). The flush line 90 should be of a length l measured from the first end 92 to the second end 94 longitudinally in an extended line of varying length depending on the tank height and flush actuating device attachment point for raising and lowering the flush valve cover 14 upon actuation of the assembly. The flush line 90 should be of a length l of about 2 inches to about 20 inches, more preferably about 5 inches to about 10 inches, and even more preferably about 6 inches to about 9 inches, and most preferably about 7 inches to about 8 inches.

A float 82 is connected to the flush valve cover 14. The float 82 may be connected to the flush line 90 at a position vertically above the flush valve cover 14. The float may be connected by a float line or as part of the flush line. If part of the flush line, the float may be anywhere along the line, but is preferably positioned at a length $l_2$ so as to be about 2 inches to about 6 inches above the flush valve cover 14, preferably about 3 inches to about 5 inches above the flush valve cover 14, and most preferably about 4 inches above the flush valve cover 14. That is, the position can be optimized for best results. The flush line 90 can also be configured to pass through the float 82 or can be split into two segments connected permanently or adjustably on two different locations, such as above and below the float 82. The position of the float 82 if detachably or adjustably connected to the flush line 90 may be locked into place by mechanical locks 96 or any locks as known or to be developed in the art for use in a toilet assembly system above and below the float 82. The position of the float 82 along the flush line 90 can be used to control the timing of the closing of the flush valve cover 14, and thereby control the flush volume. When the float 82 is located at lower positions along the flush line 90, the flush valve cover 90 will remain in the open position for a longer period of time to allow for optimization of flush timing by positioning the float in the preferred position along the flush line 90. As the water head level decreases in the tank, the float 82 also falls with the water and closes the flush valve cover 14.

Figure 10:
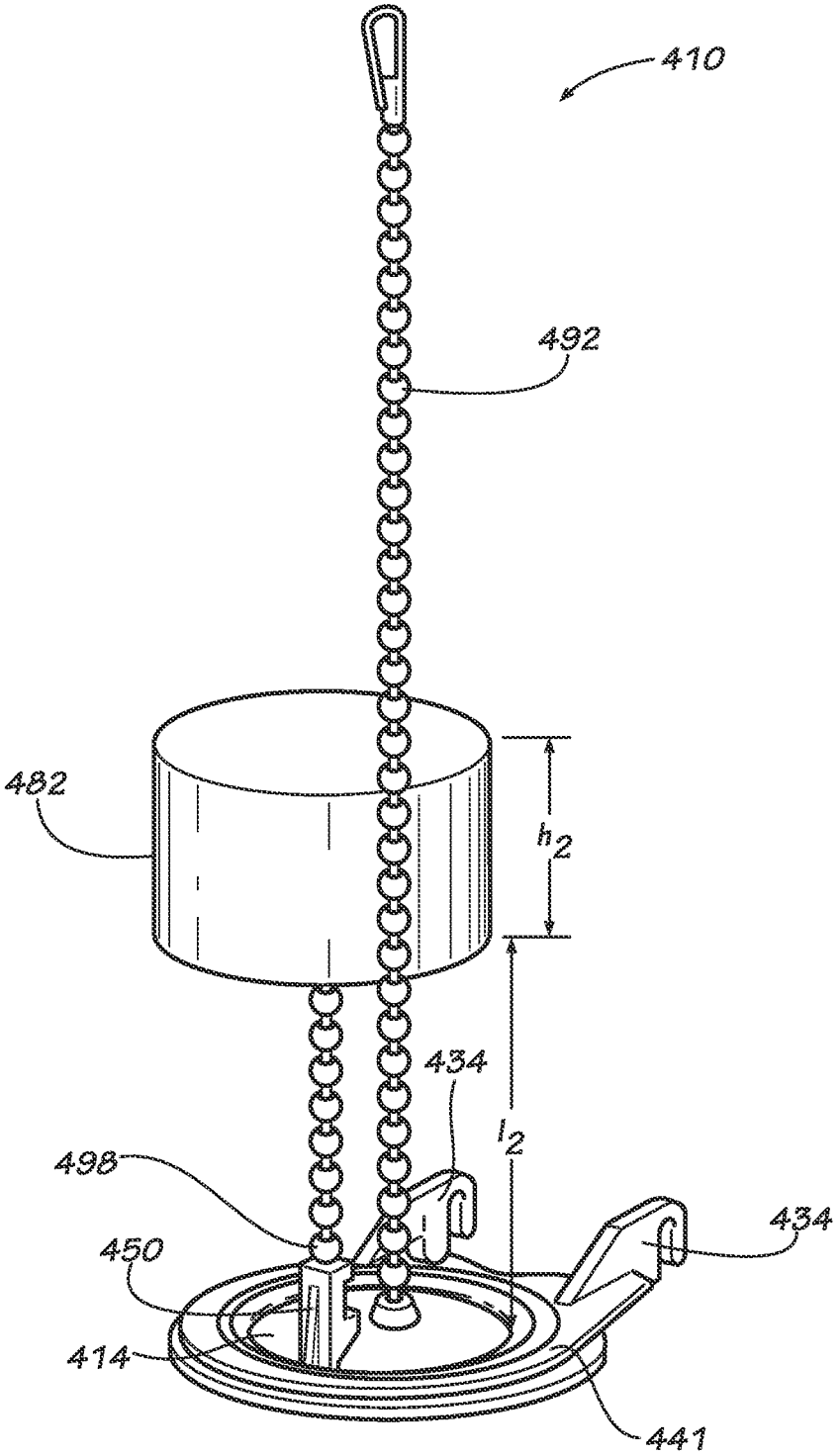
FIG. 10 is a perspective view of a float on a float line and a flush valve cover according to an alternative embodiment of the invention.

The float such as float 482 in the lid embodiment 410 in FIG. 10 may be alternatively connected to a separate float line 498, as shown in FIG. 10. The float line 498 may be formed from the same materials as the flush line 490, including metal chain link, string, cord, rope, twine, cable, fiber, or wire suitable for use in a water environment in a toilet tank. Alternatively, the float line 498 may also be formed as a rigid rod extending upward from the valve cover 414.

The float 82 may be formed of a variety of materials selected from the group including cork, rubber, ethylene vinyl acetate (EVA) foam, closed cell foam, hollow core molded plastic, blow molded plastic, wood, thin-wall plastic, thin-wall metals (i.e., hollow aluminum, brass, copper, stainless steel), polyethylene foam, polypropylene foam, expanded polystyrene (EPS), or molded hollow core acrylonitrile butadiene styrene (ABS), and combinations thereof, and preferably closed cell foam. These low-density materials allow floats as incorporated herein to have a preferred density of about 2 $lbs/ft^3$, which helps to achieve a desired buoyancy at an increased flow rate.

Figure 4:
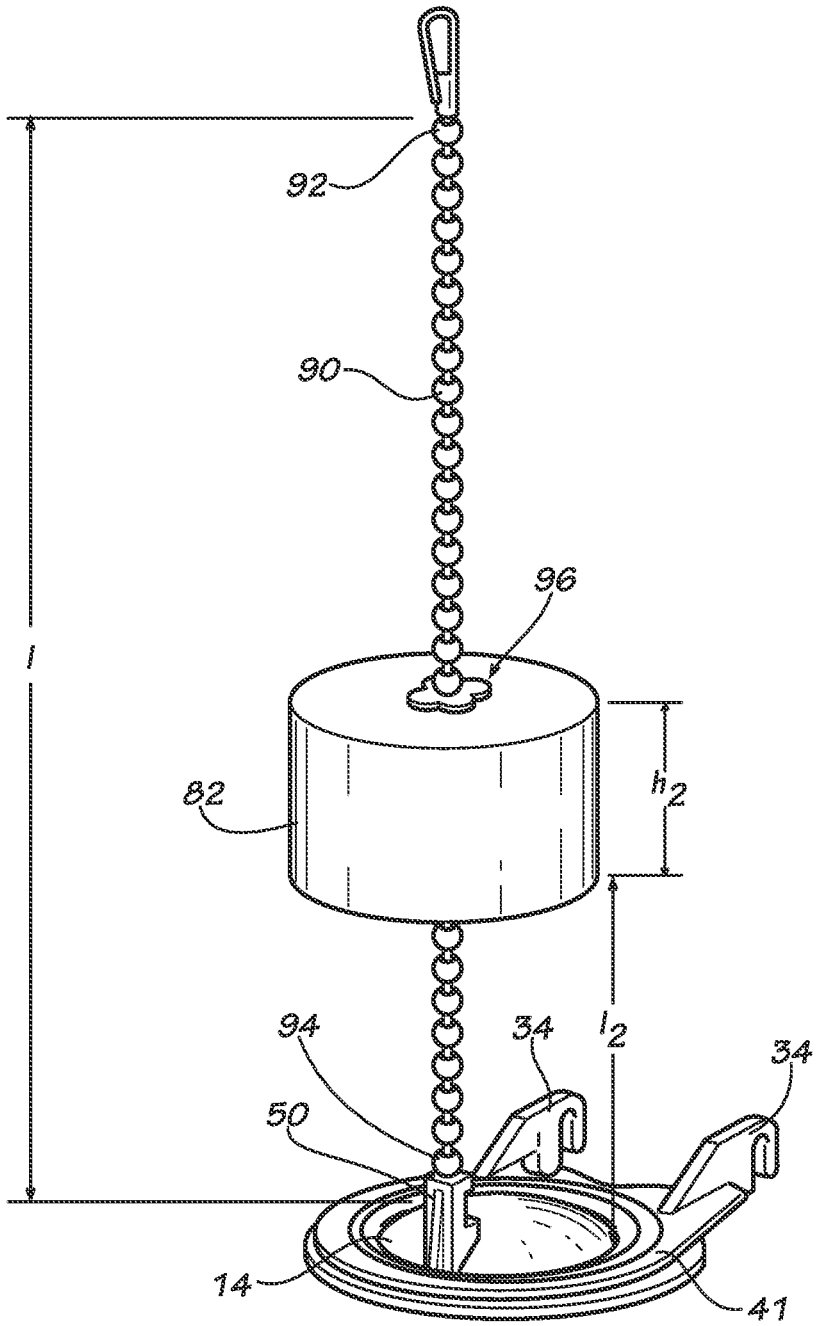
FIG. 4 is a perspective view of a float and a flush valve cover in the assembly of FIG. 3.

The float 82 may be made so as to have different heights depending on the dimensions of the attached tank and float configuration. As best seen in FIG. 4, the float 82 is generally measured at a height $h_2$ measured longitudinally along the float at its tallest point of about 1 inch to about 2 inches, and more preferably about 1.5 inches, so as to be capable of having a high buoyant force and staying afloat in high water levels. Preferably, it has a generally circular transverse cross section and a transverse diameter $d_5$ of about 1 inch to about 3 inches, more preferably about 2.5 inches, and as shown has a diameter larger than the diameter of the flush valve cover 14.

The float 82 can be of various shapes, including a sphere, cylinder, cube, cone, paraboloid, or barrel. As shown, it is generally a cylindrical shape. The float 82 is sufficiently sized to allow flush water at a water head height of from about 6 inches to about 15 inches, and more preferably of about 8 inches to about 12 inches, as measured longitudinally going vertically upward from the tank floor T to flow through the flush valve body 12 by keeping the flush valve cover 14 open for a longer period of time and providing a peak flow rate. The float 82 has a buoyant force which is equivalent to a force needed to displace from about 70 grams to about 170 grams of water with air, more preferably from about 100 grams to about 140 grams of water with air, and most preferably about 120 grams of water with air. This creates a peak flow rate in the flush valve assembly 10 measured at an outlet of the flush valve 10 which is higher than can be achieved using prior designs similarly made without a float. A flapper bulb cover as in U.S. Pat. No. 8,266,733 B2 is configured to displace approximately 75 grams of water with air, creating a good flow rate of about 5700 ml/second through a flush valve assembly at a height of about 8 inches. However, by moving the float 82 outside of the flow path 30 through the flush valve body 12, the present design improves performance at the same flow rate to allow for further enhanced bowl flush dynamics and toilet performance in cleaning and clearing of waste.

The float 82 is preferably detachably connected through its center to the flush line 90 below an actuator, such as lever L', and above a flush valve cover 14 at a length $l_2$ along the flush line 90 from the top of the flush valve cover 14 to the bottom of the float 82 of about 2 to about 6 inches, more preferably about 3 to about 5 inches, and even more preferably about 4 inches in HPT and, most preferably, HET systems to enable flushing 1 gallon of water. For a given tank water level, if the length $l_2$ is decreased, more water will be dispensed through the valve body 12 and if the length $l_2$ is increased, less water will be dispensed through the valve body 12. The float 82 and the flush line 90 may be detachably connected to one another by interlocking snap-fit pieces, connectors, pass-through, friction fit within a central passage and the like. Any suitable connection mechanism for adjoining the pieces or assembling them in a stable manner may be used, provided the pieces remain assembled in working condition. The length $l_2$ between the float 82 and the flush valve cover 14 may be adjusted to accommodate for desired flush volumes. As the length $l_2$ between the float 82 and the flush valve cover 14 is increased, the flush volume will decrease.

Upon flushing or actuation, the flush line 90 is pulled upwards by a lever L or a similar flush actuating device so as to raise the flush valve cover 14 to an open position and allow the tank water volume to flow into the inlet opening 20 of the valve body. The flush valve cover 14 is kept open by buoyant forces of the float 82, and when flushing is complete, the flush line 90 and the float 82 lower the flush valve cover 14 to close. Preferably, an elastomeric seal 54 or gasket is positioned or attached to a lower surface of the valve cover 14 and closes against the radiused inlet 16, so that upon refilling, additional flush water cannot enter the valve body 12 until the next flush cycle. The seal 54 can be formed from a variety of materials, including polyvinyl chloride, silicone, ethylene propylene diene monomer (EPDM), and Nitrile (Buna-N), and is preferably formed from silicone. The drop in water level in the tank is generally used to trigger activation of a standard fill mechanism in the toilet (not shown) is and water again fills the tank.

As noted above, the valve body 12 may be configured so that the diameter of the flow path 30 is not constant along its length. The valve body 12 preferably includes an upper inlet section $R_1$, a base section B, and an extension section E situated between the base section B and the inlet section $R_1$. The upper inlet section $R_1$ of the valve body in FIGS. 3A and 3B includes the radiused inlet portion 16 and may or may not have a downwardly extending wall segment such as segment 56 in FIG. 5A which shows a detachable upper inlet section $R_1$. The downwardly extending wall segment 56 may be configured so that the interior surface 57 is perpendicular to the toilet tank floor T and the edge of the lower outlet end when the valve body is installed. However, it may also be tapered below the radiused inlet portion to be downwardly linearly tapered so as to have a decreasing diameter as measured transversely across the valve body below the radiused inlet portion.

As shown in FIG. 5A, the upper inlet section $R_1$ has a largest diameter $d_2$ which is preferably equivalent to d in FIGS. 3A and 3B and an interior flow path diameter $d_3$ in the downwardly extending wall segment 56 which may be equivalent to or slightly larger than diameter $d_1$.

The extension section E can have a flow profile formed by an interior surface 59 thereof which is perpendicular to the toilet tank floor T or the lower outlet end 22 of the valve body 12, but which may also be downwardly linearly tapered so as to have a decreasing diameter as measured transversely across the valve body from an upper end 60 of the extension section to the lower end 62 of the extension section. The thickness/height of the extension section can also be varied, within the constraints of the toilet tank area available for the valve body installation and can be formed integrally with the upper inlet section or detachable thereto.

A base section B forms the remaining section of the valve body 12 from the extension section E to the lower outlet end 22 of the valve body for attaching the valve body to the toilet tank floor T, so that a portion of the base section B is above the tank floor T and a portion is below the tank floor T when the valve body is installed on the tank. The base section B has an interior surface 64 which forms a flow path that may be completely straight and perpendicular to the tank floor T or the outlet end 22 of the valve body throughout base section B, or may have at least a portion which lies above the tank floor T on installation of the valve body which is also tapered in a linearly downward direction from an upper end 66 in a direction towards a lower end 68 of the base section B.

The base section B, preferably also includes a sealing ring 70 (see FIG. 3A) to seat the valve body 12 against the opening in the tank floor T. The outer surface 72 of the valve body along the base portion is preferably threaded so as to have threads 74 for receiving a locking connection ring 76 (as shown in FIGS. 3A and 3B) or similar device for securing the seal against the tank. While a ring, threaded end and locking connector are shown herein, it should be understood based on the disclosure that other locking and sealing mechanisms may be used within the scope of the invention.

Figure 6:
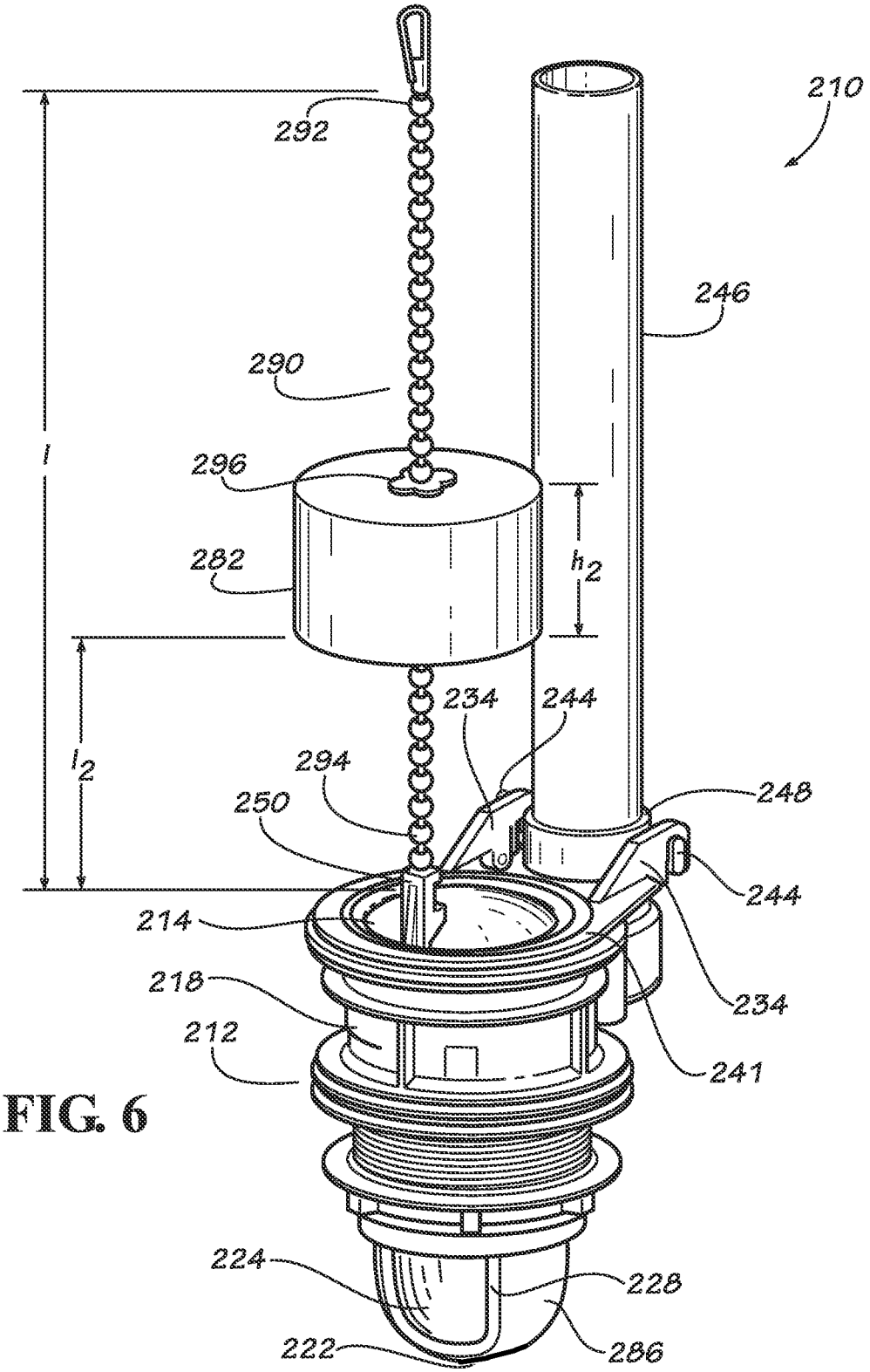
FIG. 6 is a perspective view of a flush valve assembly according to an alternate embodiment of the invention having a radiused outlet portion.
Figure 6A:
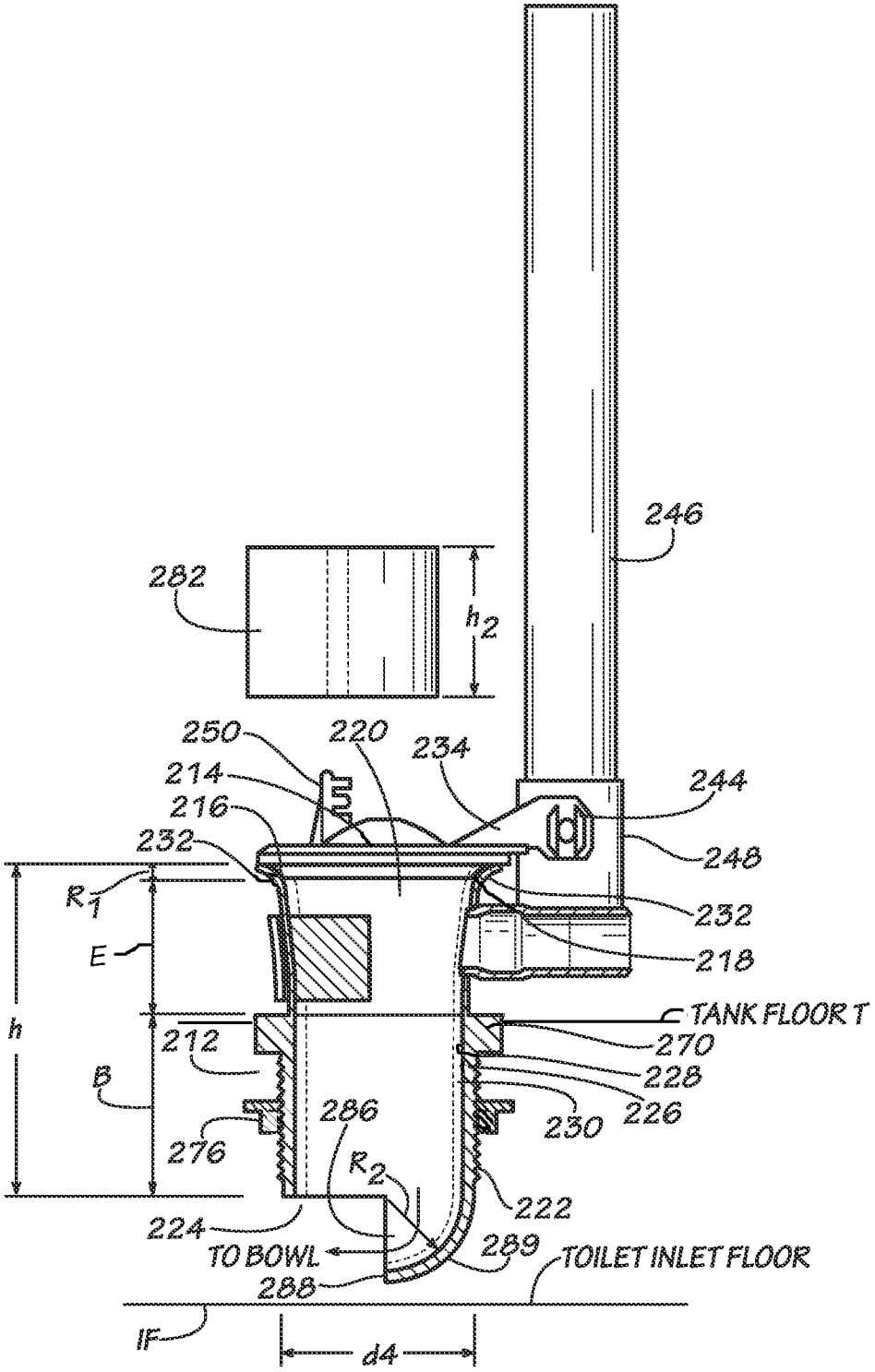
FIG. 6A is a longitudinal cross-sectional view of a float, flush valve cover, and valve body of FIG. 6.
Figure 7:
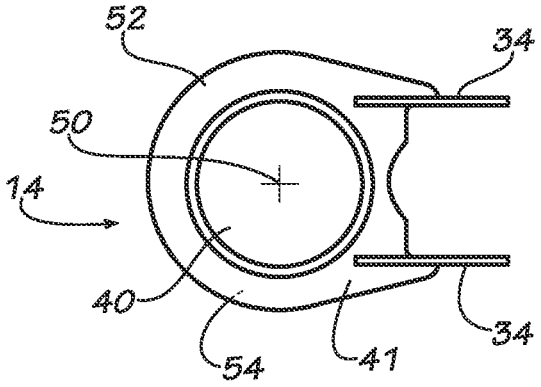
FIG. 7 is a top plan view of the detachable flush valve cover of FIG. 3A.

FIGS. 6 and 6A shows an alternate embodiment of an assembly to that of FIG. 3 generally referred to herein as assembly 210. But for its radiused outlet portion 286, as described below, in all other respects is the same with like numbers referring to like parts unless otherwise specified herein. The valve body 212 has an upper inlet end 218 having an inlet opening 220 therethrough, a lower outlet end 222 having an outlet opening 224 therethrough. The valve body 212 also has a radiused outlet portion 286. The valve body 212 has a wall 226 extending between the upper inlet end 218 and the lower outlet end 222 and an interior surface 228 that defines the flow path 230 through the valve body 212. The flow path extends generally longitudinally through an upper inlet portion 218 of the valve body 212, although sections of the valve body 212 within the upper inlet portion 218 may be tapered. Such tapering is as shown in the embodiment of FIGS. 3A, 3B and 5A, and in FIG. 6A and wherein the valve body 212 of assembly 210 may have an upper inlet end $R_1$, an extension section E and a base section B as discussed above with respect to the valve body 12 in the embodiment of the valve assembly 10, and at least one or more of such sections in assembly 210 may be tapered as discussed above as well.

The flow path 230 also preferably has a generally circular transverse cross section within the upper inlet portion 218 so that the flow of water through the flow path extends through the upper inlet portion 218 to the radiused outlet portion 286 and ultimately through the outlet opening 224.

The radiused outlet portion of the embodiments of FIGS. 6 and 6A are the same and are formed from a depending section 288 of the wall 226. The depending section 288 extends downwardly and then curves so as to terminate in the lower outlet end 222 of the valve body 212. In curving, the depending wall section 288 has a curved elbow portion 289 which forms a turn or "scoop" effect on the bottom of the radiused outlet portion 288. The radiused outlet portion 288 is configured so as to be capable of changing the direction of the flow path 230 so that water is directed through the flow path from a generally downwardly directed longitudinal flow through the upper inlet portion 218 of the valve body 212 (with the understanding that some portions thereof may be tapered) then along the curved elbow portion 289 and finally into a generally transversely extending direction upon exiting the lower outlet end 222 of the valve body 212. Such transversely flowing water then may enter a toilet bowl in a toilet bowl assembly, such as through an inlet chamber or manifold below the toilet tank floor T without impacting a lower inlet floor of such chamber in a perpendicular manner. Instead the flow would pass easily and in a more laminar manner into the inlet chamber or manifold of a toilet bowl in a toilet assembly (not shown).

FIG. 6A shows the configuration of the outlet opening 224 of the valve body 212 as having a longitudinal cross-section that is generally semi-circular and further shows a radius $R_2$ in the radiused outlet 286. The radiused outlet 286 can be sized depending on the space available below the tank floor and so as to extend as low as practical or desirable for the flow profile of an inlet chamber of a toilet bowl into which it is configured to extend. The radius $R_2$ is preferably about one half of the diameter $d_4$, which is preferably about equal to $d_1$, of the valve body measured along a lower portion of the base section B of the valve body. Preferably, as shown in FIGS. 6 and 6A, the valve body 212 having the radiused outlet portion 286 may also have a radiused inlet 216 so as to optimize and maximize hydraulic flow and resist loss of hydraulic energy through the valve body 212. If the valve body is being used in a HPT or an HET as is preferred and has a valve body diameter $d_4$ along a lower portion of the base section of the valve body as noted above of about size of 2 inches, it is preferred, as with the valve bodies of the flush valve assemblies 10 shown elsewhere herein, that the radius r of the radiused inlet 216 is sized as noted above, preferably about ⅛ inch to about ⅜ inch. The radiused outlet portions 286 described herein for use with varying valve body configurations for flush valve assemblies may be formed integrally as part of a unitary structure or affixed to one piece of a valve body from which it depends, or may be a separate detachable piece that can be used as a fitting on any available valve body provided it is able to fit below the tank floor and into an inlet chamber of a toilet bowl in a toilet assembly.

As shown in the embodiment of FIGS. 3A, 3B and 5A and in the alternate embodiment of FIG. 6A, a highlight of the flow path 30/230 profile of the valve body 12/212 is shown demonstrating flow that curves around a radiused inlet portion in the inlet section of the valve body 12/212, flows in a direction perpendicular to the tank floor T on installation through the extended wall portion of the inlet section, flows in a downward linearly tapered manner through the extension section and flows in a direction perpendicular to the tank floor T on installation through the straight base section until, in 6A only, it curves to a transverse flow.

Figure 9:
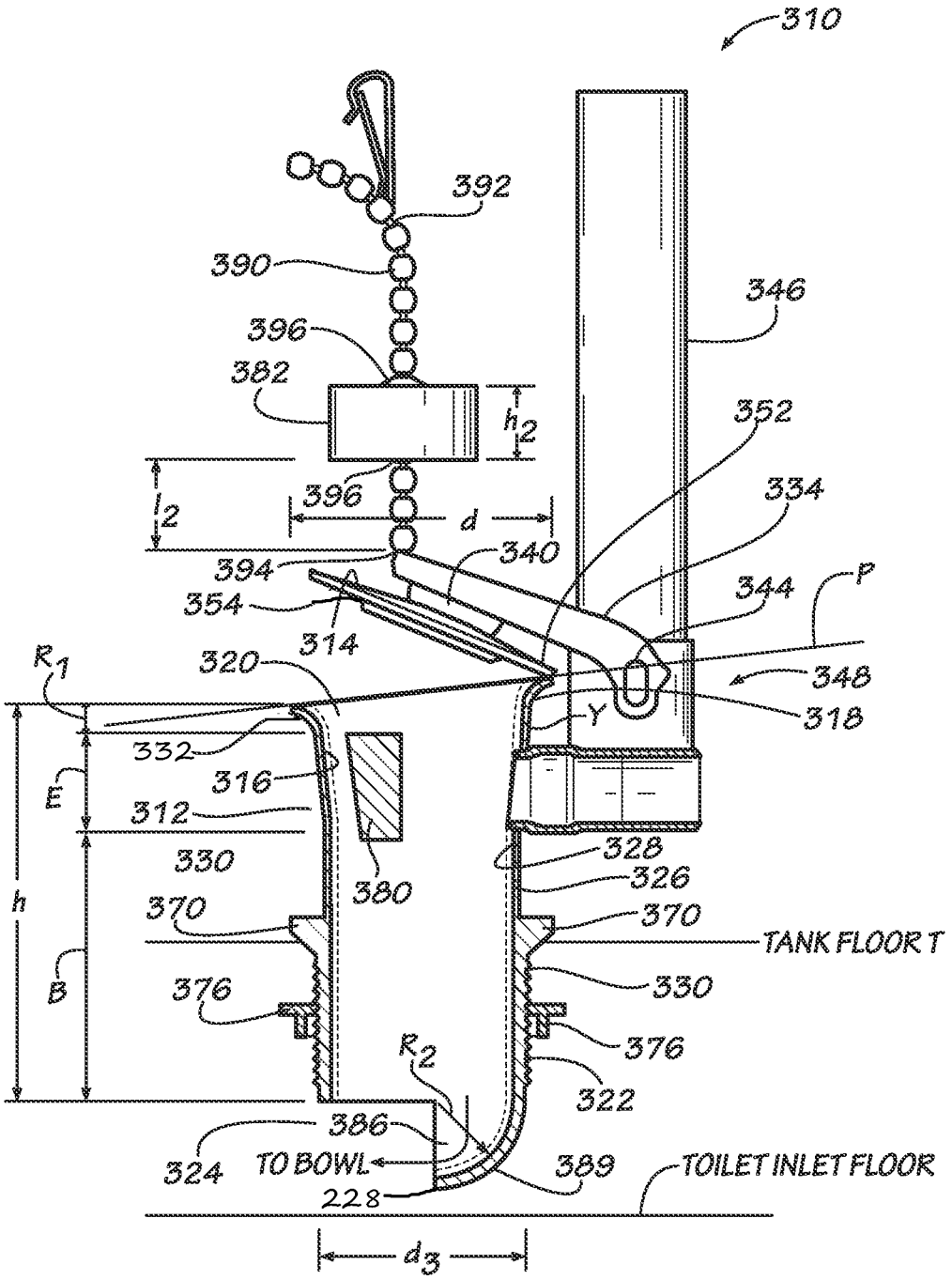
FIG. 9 is a longitudinal cross-sectional view of a flush valve assembly according to an alternate embodiment of the invention having an elevated and am angled upper inlet portion of the valve body and a radiused outlet portion.

FIG. 9 shows an alternate embodiment to that of FIG. 6 generally referred to herein as assembly 310. But for its upper inlet portion 318 of the valve body 312 being angled as described below in all other respects is the same. As shown in FIG. 9, when using a flush valve cover 314 with the valve body 312, in view of the flow path 330 and use of the radiused outlet 386, the valve body 312 has an upper inlet end 318 that may not be generally parallel to the tank floor and may lie in a plane P at an acute angle $\alpha$ formed by the plane P and a further plane taken through the transverse cross section of the flow path 330 at a location Y in the upper inlet portion 318 of the valve body 312. The angle $\alpha$ is configured so as to create a wider inflow area for water entering the valve body and a larger volume in the upper inlet section of the valve body to facilitate increased flow of water into the inlet opening 320 of the valve body when using a pivoting flush valve cover 314. The angle may vary from about 1° to about 25°, or from about 5° to about 10°.

The invention will now be described with respect to the following non-limiting example.

EXAMPLE

Figure 11:
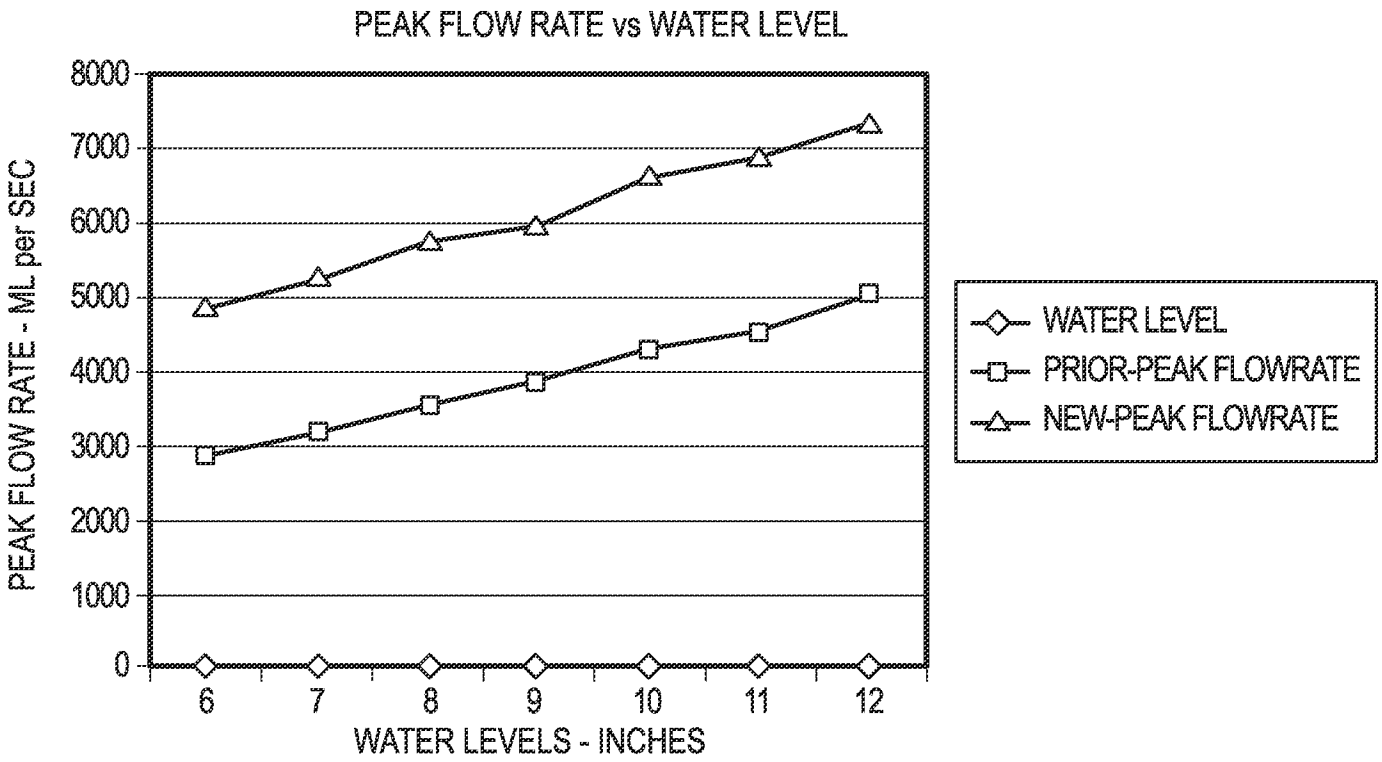
FIG. 11 is a graphic representation of the comparative testing of a prior art flush valve assembly and an embodiment according to FIG. 3 of the invention.

The average of the flow rate properties of a standard commercially available flush valve assembly (Fluidmaster® 507 flush valve) according to the prior art as shown in FIGS. 1, 1A and 2 were compared to an average of the flow rate properties of a flush valve assembly made according to an embodiment herein after two consecutive flush cycles using varying water levels. The results of the comparison between the peak flow rates at certain tank water head levels are shown in Table 1, and represented graphically in FIG. 11. This data demonstrates that the peak flow rate of the flush valve assembly of the present invention was higher than that of the flush valve assembly of the prior art over a variety of tank water levels.

TABLE 1

| WATER LEVEL - INCHES | COMPARATIVE EXAMPLE - PEAK FLOW RATE (ml/s) | INVENTIVE EXAMPLE - PEAK FLOW RATE (ml/s) |
|---|---|---|
| 6 2 | 884 | 4874 |
| 7 3 | 200 | 5264 |
| 8 3 | 550 | 5772 |
| 9 3 | 848 | 5962 |
| 10 4 | 294 | 6640 |
| 11 4 | 524 | 6890 |
| 12 5 | 016 | 7332 |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A flush valve assembly, comprising, a flush valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the flush valve body from the inlet opening to the outlet opening and that has a generally circular transverse cross-section, the upper inlet end of the wall further comprising at least one peripheral rib formed on the interior surface of the wall, the at least one peripheral rib spaced from an inlet of an overflow tube, wherein at least a portion of the wall is downwardly linearly tapered and has a decreasing flush valve body diameter as measured transversely across the flush valve body, and the portion of the wall that is downwardly linearly tapered is below the radiused inlet portion, wherein a height measured longitudinally through the flush valve body is about the same as or greater than a largest diameter of the transverse cross-section of the flow path;

a flush valve cover detachably connected to a flush line;

a pivot mechanism capable of opening and closing the flush valve cover upon actuation of the flush valve, wherein the flush valve cover has a transverse cross-sectional diameter sufficiently large to cover the inlet opening of the flush valve body;

the flush line connected at a first end to a flush actuating device and connectable at a second end to the flush valve cover, the flush line being capable of raising and lowering the flush valve cover upon actuation of the assembly; and a float connected to the flush valve cover via a float line or by being positioned along the flush line;

wherein the float is sufficiently buoyant so as to resist the force of flowing water, keeping the flush valve cover open and the flow path unobstructed by the float or flush valve cover so as to allow flush water to pass through the flush valve body before closing the flush valve cover when the flush valve body is installed on a toilet and so that when a diameter of the lower outlet end of the flush valve body is about 2 inches, the float has a buoyant force which is equivalent to a force needed to displace from about 70 grams to about 170 grams of water with air, and wherein a flow of liquid through the flush valve body into a toilet bowl remains unobstructed if the at least one peripheral rib is in use.

2. The flush valve assembly according to claim 1, wherein the float is sufficiently buoyant so as to be capable of resisting the force of flowing water, keeping the flush valve cover open so as to allow flush water to pass through the flush valve body when the flush valve body is installed on a toilet having a flush volume of about 1.6 gallons per flush or less, before closing the flush valve cover.

3. The flush valve assembly according to claim 1, wherein the float is sufficiently buoyant so as to be capable of resisting the force of flowing water, keeping the flush valve cover open so as to allow flush water to pass through the flush valve body when the flush valve body is installed on a toilet having a flush volume of about 1.28 gallons per flush or less, before closing the flush valve cover.

4. The flush valve assembly according to claim 1, wherein the valve body wall further comprises:

an upper inlet section for contacting the flush valve cover when the flush valve cover is in the closed position;

a base section for attaching to a toilet tank floor; and an extension section situated between the upper inlet section and the base section.

5. The flush valve assembly according to claim 4, wherein the upper inlet section, the base section and the extension section are detachably connected.

6. The flush valve assembly according to claim 4, wherein the upper inlet section, the base section and the extension section are integrally formed as a unitary structure.

7. The flush valve assembly according to claim 4, wherein at least one of an interior surface of the base section and the extension section is tapered so as to have a linearly decreasing diameter from an upper end of each section in a direction towards a lower end of each section, wherein the diameters are measured transversely across each section.

8. The flush valve assembly according to claim 7, wherein both of the interior surfaces of the base section and the extension section are tapered.

9. The flush valve assembly according to claim 1, wherein the float is connected to the flush valve cover by the float line.

10. The flush valve assembly according to claim 9, wherein the float line is formed from materials selected from the group comprising plastic, metal, chain link, string, cord, rope, twine, stainless steel cable, fiber, rigid rod or wire.

11. The flush valve assembly according to claim 1, wherein the float is adjustably connected to the flush valve cover by the flush line.

12. The flush valve assembly according to claim 11, wherein the flush line is formed from a materials selected from the group comprising plastic, metal, chain link, string, cord, rope, twine, stainless steel cable, fiber, rigid rod or wire.

13. The flush valve assembly according to claim 1, wherein the float has a buoyant force which is equivalent to a force needed to displace from about 100 grams to about 140 grams of water with air.

14. The flush valve assembly according to claim 13, wherein the float has a buoyant force which is equivalent to a force needed to displace 120 grams of water with air.

15. The flush valve assembly according to claim 1, wherein a radius of the radiused inlet portion is about ⅛ inch to about 2 inches.

16. The flush valve assembly according to claim 15, wherein the radius of the radiused inlet portion is about ⅜ inch.

17. The flush valve assembly according to claim 1, wherein the at least one peripheral rib extends at least partially longitudinally along the flow path and at least partially transversely inwardly from the interior surface into the flow path.

18. The flush valve assembly according to claim 1, wherein the float is capable of staying afloat in a tank having a starting water head of about 9 inches to about 10 inches above the flush valve body so as to provide a peak flow rate measured at the outlet of the flush valve of at least about 5900 ml/s.

19. The flush valve assembly according to claim 1, wherein the float is adjustably connected to the flush line via one or more locks.

20. The flush value of assembly of claim 1, wherein the flush valve cover comprises a thickness measured longitudinally through the flush valve cover at its thickest point of about 0.032 inches to about 0.150 inches.

21. The flush valve assembly of claim 1, wherein the at least one peripheral fib prevents the use of an after-market flapper.

22. The flush valve assembly of claim 1, wherein the at least one peripheral rib prevents obstruction of a flow of liquid through the valve body.

23. A flush valve assembly useful for a high efficiency toilet, comprising, a valve body having a radiused inlet portion, an upper inlet end having an inlet opening therethrough, a lower outlet end having an outlet opening therethrough, a wall extending between the upper inlet end and the lower outlet end and having an interior surface defining a flow path that extends generally longitudinally through the valve body from the inlet opening to the outlet opening and that has a generally circular transverse cross-section, the upper inlet end of the wall further comprising at least one peripheral rib formed on the interior surface of the wall, the at least one peripheral rib spaced from an inlet of an overflow tube, wherein the wall has an upper inlet section, a base section for attaching to a toilet tank floor, and an extension section situated between the upper inlet section and the base section, wherein an upper portion of the base section is tapered so as to have a linearly decreasing diameter from an upper end of the base section in a direction towards a lower end of the base section, wherein the diameters of the base section are measured transversely across the base section, wherein a height measured longitudinally through the valve body is about the same as or greater than a largest diameter of the transverse cross-section of the flow path; and a flush valve cover detachably connected to a flush line;

a pivot mechanism capable of opening and closing the flush valve cover upon actuation of the flush valve, wherein the flush valve cover has a transverse cross-sectional diameter sufficiently large to cover the inlet opening of the valve body;

the flush line connected at a first end to a flush actuating device and connectable at a second end to the flush valve cover, the flush line being capable of raising and lowering the flush valve cover upon actuation of the assembly; and a float connected to the flush valve cover via a float line or by being positioned along the flush line, wherein at least a portion of the float is positioned over and above the flush valve when the flush valve is in a closed position;

wherein the float is sufficiently buoyant so as to resist the force of flowing water, keeping the flush valve cover open and the flow path unobstructed by the float or the float valve cover so as to allow flush water to pass through the valve body before closing the flush valve cover when the valve body is installed on a toilet and so that when a diameter of the lower outlet end of the valve body is about 2 inches, the float has a buoyant force which is equivalent to a force needed to displace from about 70 grams to about 170 grams of water with air, and wherein a lower surface of the flush valve cover is longitudinally spaced from an upper surface of the at least one peripheral rib.

24. The flush valve assembly according to claim 23, wherein the float is sufficiently buoyant so as to be capable of resisting the force of flowing water, keeping the flush valve cover open so as to allow flush water to pass through the valve body when the valve body is installed on a toilet having a flush volume of about 1.6 gallons per flush or less, before closing the flush valve cover.

25. The flush valve assembly according to claim 23, wherein the float is sufficiently buoyant so as to be capable of resisting the force of flowing water, keeping the flush valve cover open so as to allow flush water to pass through the valve body when the valve body is installed on a toilet having a flush volume of about 1.28 gallons per flush or less, before closing the flush valve cover.

26. The flush valve assembly according to claim 23, wherein the float is connected to the flush valve cover by the float line.

27. The flush valve assembly according to claim 23, wherein the float is adjustably connected to the flush valve cover by the flush line.

28. The flush valve assembly according to claim 23, wherein the extension section is also tapered so as to have a linearly decreasing diameter from an upper end of the extension section to the lower end of the extension section, wherein the diameters of the extension section are measured transversely across the extension section.

29. The flush valve assembly according to claim 23, wherein the at least one peripheral rib extends at least partially longitudinally along the flow path and at least partially transversely inwardly from the interior surface into the flow path.

30. A flush valve assembly, comprising, a flush valve body having an upper inlet end having an inlet opening therethrough, a lower outlet end having an outlet opening therethrough, a radiused outlet portion, a wall extending between the upper inlet end and the lower outlet end and having an interior surface defining a flow path that extends generally longitudinally through an upper inlet portion of the flush valve body, wherein the flow path has a generally circular transverse cross-section therein, and that extends through the radiused outlet portion, the upper inlet end of the wall further comprising at least one peripheral rib formed on the interior surface of the wall, the at least one peripheral rib spaced from an inlet of an overflow tube, wherein the radiused outlet portion includes a longitudinally depending section of the wall of the flush valve body and terminates in the lower outlet end of the valve body, wherein the longitudinally depending wall section has a curved elbow portion, wherein the flush valve body having the radiused outlet portion is configured so as to be capable of directing water through the flow path from a generally downwardly directed longitudinal flow through the upper inlet portion of the flush valve body, along the curved elbow portion of the radiused outlet portion and into a transversely directed flow upon exiting the lower outlet end of the flush valve body towards an inlet of a bowl of a toilet assembly, wherein the lower outlet end has a generally semi-circular longitudinal cross-section;

a flush valve cover detachably connected to a flush line;

a pivot mechanism capable of opening and closing the flush valve cover upon actuation of the flush valve, wherein the flush valve cover has a transverse cross-sectional diameter sufficiently large to cover the inlet opening of the flush valve body;

the flush line connected at a first end to a flush actuating device and connectable at a second end to the flush valve cover, the flush line being capable of raising and lowering the flush valve cover upon actuation of the assembly; and a float connected to the flush valve cover via a float line or by being positioned along the flush line, wherein at least a portion of the float is positioned over and above the flush valve when the flush valve is in a closed position;

wherein the float is sufficiently buoyant so as to resist the force of flowing water, keeping the flush valve cover open and the flow path unobstructed by the float or valve cover so as to allow flush water to pass through the valve body before closing the flush valve cover when the valve body is installed on a toilet and so that when a diameter of the lower outlet end of the valve body is about 2 inches, the float has a buoyant force which is equivalent to a force needed to displace from about 70 grams to about 170 grams of water with air, and wherein the flow of liquid through the flush valve body into a toilet bowl remains unobstructed if the at least one peripheral rib is in use.

31. The flush valve assembly according to claim 30, wherein the flush valve body comprises a radiused inlet portion on the upper inlet portion of the flush valve body, and wherein at least a portion of the interior surface of the flush valve body is downwardly linearly tapered.

32. The flush valve assembly according to claim 31, wherein the flush valve body has a diameter measured transversely across the flush valve body at a location where the flush valve body would be situated so as to pass through a toilet tank floor when installed on a toilet and above the radiused outlet portion which is about 2 inches, the radiused inlet portion has a radius which is about ⅛ to about 2 inches, and the float is sufficiently buoyant so as to be capable of resisting the force of flowing water, keeping the flush valve cover open so as to allow flush water to pass through the flush valve body when the flush valve body is installed on a toilet having a flush volume of about 1.6 gallons per flush or less, before closing the flush valve cover.

33. The flush valve assembly according to claim 30, wherein the float is sufficiently buoyant so as to be capable of resisting the force of flowing water, keeping the flush valve cover open so as to allow flush water to pass through the flush valve body when the flush valve body is installed on a toilet having a flush volume of about 1.28 gallons per flush or less, before closing the flush valve cover.

34. The flush valve assembly according to claim 30, wherein the upper inlet end of the flush valve body lies in a plane that is at an acute angle with the transverse cross section of the flow path taken at a location in the upper inlet portion of the flush valve body, wherein the angle is configured to create a wider inflow area for water entering the flush valve body when the flush valve cover is open to facilitate increased flow of water into the inlet opening of the flush valve body.

35. The flush valve assembly according to claim 30, wherein the radiused outlet portion is detachably connected to the upper inlet portion of the flush valve body.

36. The flush valve assembly according to claim 30, wherein the radiused outlet portion is integrally formed with the upper inlet portion of the flush valve body as a unitary structure.

37. The flush valve assembly according to claim 30, wherein the at least one peripheral rib extends at least partially longitudinally along the flow path and at least partially transversely inwardly from the interior surface into the flow path.

38. A flush valve assembly, comprising, a flush valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the flush valve body from the inlet opening to the outlet opening and that has a generally circular transverse cross-section, the upper inlet end of the wall further comprising at least one peripheral rib formed on the interior surface of the wall, the at least one peripheral rib spaced from an inlet of an overflow tube, wherein at least a portion of the wall is downwardly linearly tapered and has a decreasing valve body diameter as measured transversely across the flush valve body, and the tapered wall portion is below the radiused inlet portion, wherein a height measured longitudinally through the flush valve body is about the same as or greater than a largest diameter of the transverse cross-section of the flow path;

a flush valve cover detachably connected to a flush line;

a pivot mechanism capable of opening and closing the flush valve cover upon actuation of the flush valve, wherein the flush valve cover has a transverse cross-sectional diameter sufficiently large to cover the inlet opening of the flush valve body;

wherein the pivot mechanism comprises a pivot arm that extends outwardly from a center section of the flush valve cover and pivots about at least one protruding arm of the overflow tube;

the flush line connected at a first end to a flush actuating device and connectable at a second end to the flush valve cover, the flush line being capable of raising and lowering the flush valve cover upon actuation of the assembly; and a float flexibly connected to the flush valve cover via a float line or by being positioned along the flush line so as to be free floating with respect to the flush valve cover, wherein at least a portion of the float is positioned over and above the flush valve when the flush valve is in a closed position;

wherein the float is sufficiently buoyant so as to resist the force of flowing water, keeping the flush valve cover open so as to allow flush water to pass through the flush valve body before closing the flush valve cover when the flush valve body is installed on a toilet, and wherein a flow of liquid through the flush valve body into a toilet bowl remains unobstructed if the at least one peripheral rib is in use.

39. A flush valve assembly, comprising, a valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the valve body from the inlet opening to the outlet opening and that has a generally circular transverse cross-section, the upper inlet end of the wall further comprising at least one peripheral rib formed on the interior surface of the wall, the at least one peripheral rib spaced from an inlet of an overflow tube, wherein at least a portion of the wall is downwardly linearly tapered and has a decreasing valve body diameter as measured transversely across the valve body, and the portion of the wall that is downwardly linearly tapered is below the radiused inlet portion, wherein a height measured longitudinally through the valve body is about the same as or greater than a largest diameter of the transverse cross-section of the flow path;

a flush valve cover detachably connected to a flush line;

a pivot mechanism external to the valve body and capable of opening and closing the flush valve cover via a pivoting motion upon actuation of the flush valve, wherein the flush valve cover has a transverse cross-sectional diameter sufficiently large to cover the inlet opening of the valve body;

the flush line connected at a first end to a flush actuating device and connectable at a second end to the flush valve cover, the flush line being capable of raising and lowering the flush valve cover upon actuation of the assembly; and a float connected to the flush valve cover via a float line or by being positioned along the flush line;

wherein the float is sufficiently buoyant so as to resist the force of flowing water, keeping the flush valve cover open and the flow path unobstructed by the float or flush valve cover so as to allow flush water to pass through the valve body before closing the flush valve cover when the valve body is installed on a toilet and so that when a diameter of the lower outlet end of the valve body is about 2 inches, the float has a buoyant force which is equivalent to a force needed to displace from about 70 grams to about 170 grams of water with air, and wherein a lower surface of the flush valve cover is longitudinally spaced from an upper surface of the at least one peripheral rib.

40. The flush valve assembly according to claim 39, wherein the pivoting mechanism comprises a pivot arm that extends outwardly from the valve cover and is pivotally connected to the overflow tube.

* * * * *